US010870902B2

(12) United States Patent
Ono et al.

(10) Patent No.: US 10,870,902 B2
(45) Date of Patent: Dec. 22, 2020

(54) COLD-ROLLED STEEL SHEET AND MANUFACTURING METHOD THEREFOR

(71) Applicant: JFE STEEL CORPORATION, Tokyo (JP)

(72) Inventors: Yoshihiko Ono, Tokyo (JP); Yoshimasa Funakawa, Tokyo (JP); Ryosuke Yamaguchi, Tokyo (JP); Nobuyuki Nakamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 595 days.

(21) Appl. No.: 15/558,201

(22) PCT Filed: Mar. 23, 2016

(86) PCT No.: PCT/JP2016/001695

§ 371 (c)(1),
(2) Date: Sep. 14, 2017

(87) PCT Pub. No.: WO2016/152163

PCT Pub. Date: Sep. 29, 2016

(65) Prior Publication Data

US 2018/0100212 A1 Apr. 12, 2018

(30) Foreign Application Priority Data

Mar. 25, 2015 (JP) ..... 2015-063128

(51) Int. Cl.

| | |
|---|---|
| ***C21D 9/46*** | (2006.01) |
| ***C22C 38/06*** | (2006.01) |
| ***C22C 38/60*** | (2006.01) |
| ***C22C 38/00*** | (2006.01) |
| ***C21D 8/02*** | (2006.01) |
| ***C22C 38/02*** | (2006.01) |
| ***C22C 38/04*** | (2006.01) |

(52) U.S. Cl.

CPC ..... *C21D 9/46* (2013.01); *C21D 8/0236* (2013.01); *C22C 38/00* (2013.01); *C22C 38/001* (2013.01); *C22C 38/02* (2013.01); *C22C 38/04* (2013.01); *C22C 38/06* (2013.01); *C22C 38/60* (2013.01); *C21D 2211/002* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 4,153,454 | A | 5/1979 | Emi et al. | |
| 2011/0186189 | A1* | 8/2011 | Futamura | C22C 38/04 148/622 |
| 2012/0132327 | A1 | 5/2012 | Mukai et al. | |
| 2013/0260164 | A1 | 10/2013 | Kato et al. | |

FOREIGN PATENT DOCUMENTS

| | | | | |
|---|---|---|---|---|
| EP | 2436794 | A1 | 4/2012 | |
| EP | 2592168 | B1 * | 9/2015 | C22C 38/002 |
| GB | 2477419 | A | 8/2011 | |
| JP | S5431019 | A | 3/1979 | |
| JP | 3514276 | B2 | 3/2004 | |
| JP | 4427010 | B2 | 3/2010 | |
| JP | 2010090432 | A | 4/2010 | |
| JP | 2010215958 | A * | 9/2010 | |
| JP | 2010215958 | A | 9/2010 | |
| JP | 2010275608 | A | 12/2010 | |
| JP | 2012237048 | A | 12/2012 | |
| JP | 2013213242 | A | 10/2013 | |
| JP | 5428705 | B2 | 2/2014 | |

OTHER PUBLICATIONS

JP2010215958A—Espacenet English Machine Translation (Year: 2010).*

Jun. 14, 2016, International Search Report issued in the International Patent Application No. PCT/JP2016/001695.

Mar. 23, 2018, Extended European Search Report issued by the European Patent Office in the corresponding European Patent Application No. 16768066.9.

* cited by examiner

*Primary Examiner* — Alexandra M Moore
*Assistant Examiner* — Adil A. Siddiqui
(74) *Attorney, Agent, or Firm* — Kenja IP Law PC

(57) ABSTRACT

A cold-rolled steel sheet has: a predetermined chemical composition; and a microstructure in which tempered martensite and bainite are contained in a total area ratio of 95-100% with respect to a whole volume of the microstructure; a number of predetermined inclusion groups is at most 0.8/mm$^2$, the inclusion groups being formed by one or more inclusion particles, the one or more inclusion particles having a major axis length of 0.3 μm or more and extending and/or distributed in a dot-sequence manner along a rolling direction; a number of carbides mainly composed of Fe having a predetermined size is at most 3,500/mm$^2$; a number of carbides that are distributed in the tempered martensite and/or in the bainite and that have a diameter of 10 nm to 50 nm is at least $0.7\times10^7$/mm$^2$; and prior γ grains have a mean grain size of 18 μm or less.

8 Claims, No Drawings

COLD-ROLLED STEEL SHEET AND MANUFACTURING METHOD THEREFOR

TECHNICAL FIELD

This disclosure relates to a cold-rolled steel sheet, and in particular, to a high-strength cold-rolled steel sheet suitable for manufacturing parts formed by cold pressing, such as those used in automobiles and household appliances. This disclosure also relates to a manufacturing method for the cold-rolled steel sheet.

BACKGROUND

As the need for reducing the weight of automobile bodies continues to grow, high-strength steel sheets having a TS of 1,320 MPa to 1,470 MPa have been increasingly applied to body frame parts, such as center pillar R/F (reinforcement), bumpers, and impact beam parts (hereinafter also referred to as "parts"). From the viewpoint of further weight reduction of automobile bodies, various techniques have been examined for applying steel sheets having a TS of 1,800 MPa (1.8 GPa grade) or even higher strength.

Conventionally, intensive studies have been made on application of high-strength steel sheets subjected to hot press forming. From cost and productivity perspectives, however, high-strength steel sheets subjected to cold press forming have recently become subject to new attention.

However, when a high-strength steel sheets having a TS of 1,320 MPa or more is formed into parts by cold pressing, delayed fracture may be caused by an increase in residual stress within the parts or deterioration of delayed fracture resistance of the steel sheet itself. Delayed fracture is a phenomenon that results from hydrogen being introduced into a steel sheet constituting the parts when the steel sheet is placed in a hydrogen attack environment under a high stress, lowering the interatomic bonding force or causing local deformation, forming microcracks, and leading to fracture by the development of the microcracks.

As a technique for improving such delayed fracture resistance, for example, JP3514276B (PTL 1) describes a technique for improving delayed fracture resistance by having a composition that contains C: 0.08% to 0.18%, Si: 1% or less, Mn: 1.2% to 1.8%, P: 0.03% or less, S: 0.01% or less, sol. Al: 0.01% to 0.1%, N: 0.005% or less, O: 0.005% or less, B: 5 ppm to 25 ppm, and at least one selected from the group consisting of Nb: 0.005% to 0.04%, Ti: 0.005% to 0.04%, and Zr: 0.005% to 0.04%, with Ceq and TS satisfying a relation of $TS \geq 2270 \times Ceq + 260$, $Ceq \leq 0.5$, and $Ceq = C + Si/24 + Mn/6$, and by having a microstructure that contains martensite with a volume fraction of 80% or more.

In addition, JP5428705B (PTL 2), JPS5431019A (PTL 3), and JP2013213242A (PTL 4) each describe a technique for preventing hydrogen-induced cracking by reducing S content in steel to a certain level and adding Ca to the steel.

Further, JP4427010B (PTL 5) describes a technique for improving delayed fracture resistance by having a composition that contains C: 0.1% to 0.5%, Si: 0.10% to 2%, Mn: 0.44% to 3%, N: 0.008% or less, Al: 0.005% to 0.1%, and at least one selected from the group consisting of V: 0.05% to 2.82%, Mo: 0.1% or more and less than 3.0%, Ti: 0.03% to 1.24%, and Nb: 0.05% to 0.95%, and causing dispersion of fine alloy carbides as hydrogen trap sites.

CITATION LIST

Patent Literature

PTL 1: JP3514276B
PTL 2: JP5428705B

PTL 3: JPS5431019A
PTL 4: JP2013213242A
PTL 5: JP4427010B

SUMMARY

Technical Problem

In actual pressed parts, such a delayed fracture is mostly generated originating from an end face of a steel sheet cut by shearing or punching (hereinafter also referred to as a sheared end face). The reason is thought to be that a sheared end face contains a region that has already reached a fracture limit strain (hereinafter also referred to as a strain affected zone) and considerable work hardening (namely, an increase in the proportional limit) is observed in the vicinity of the strain affected zone, which causes an increase in the residual stress remaining after the subsequent press working accordingly. In fact, the delayed fracture critical stress of a steel sheet having a sheared end face ranges from about ⅓ to 1/20 of that of a steel sheet from which strain affected zones are removed by reaming. In other words, delayed fracture resistance against delayed fracture originating from a sheared end face (hereinafter also referred to as delayed fracture resistance at a sheared end face) is considered as one of the main factors determining the delayed fracture resistance of actual parts.

However, all of the techniques described in PTLs 1 to 5 attempt to improve the delayed fracture resistance of the steel sheet itself, and do not sufficiently consider the existence of a strain affected zone at a sheared end face. Thus, with the steel sheets shown in PTLs 1 to 5, the effect of improving the delayed fracture resistance at a sheared end face is not necessarily satisfactory.

In addition, PTLs 2 to 4 are directed to so-called thick steel plates having a thickness of 10 mm or more in the first place, and are not intended for so-called thin steel sheets formed into automobile parts or the like. Such thick steel plates and thin steel sheets greatly differ in thickness, cumulative rolling reduction during manufacture, microstructure, material strength, and amount of deformation.

In view of the above circumstances, it could thus be helpful to provide a steel sheet having a thickness of 0.5 mm to 2.6 mm and a tensile strength (TS) as high as 1,320 MPa or more, and excellent in delayed fracture resistance, particularly delayed fracture resistance at a sheared end face, and an advantageous manufacturing method therefor.

As used herein, the phrase "excellent in delayed fracture resistance at a shearing end face" more specifically means that a press formed part exhibits excellent delayed fracture resistance even when subjected to cold press forming after subjection to blanking by shearing or slitting or perforation by punching, and alternatively when subjected to cold press forming before subjection to cutting by shearing or perforation by punching.

Solution to Problem

To solve the problems described above, we conducted diligent research and reached the following findings.

i) The delayed fracture resistance at a sheared end face is determined by damaging of a sheared end face (the degree to which the surface layer is hardened and the residual stress therein) and the ease of inward progression of cracks. In particular, for a high-strength steel sheet with TS≥1,320 MPa, huge inclusion groups formed of MnS, $Al_2O_3$, (Nb, Ti)(C, N), TiN, TiS, or the like that extend in a rolling direction over a length of more than 120 μm and that are distributed in a dot-sequence manner have adverse effects on the delayed fracture resistance at a sheared end face.

Such inclusions lead to an increase in local strain and residual stress inside sheared end faces and an increase in their roughness, and thus cause scratches to form on a sheared end face upon contact with another sheared end face or the press mold, as the origin of delayed fracture. Such inclusion groups are aligned in the rolling direction, and end up causing propagation of cracks. As most of such inclusion groups are present in the mid-thickness part of the steel sheet, it is insufficient to simply process the surface layer alone; instead, it is necessary to reduce inclusions across a region including the mid-thickness part of the steel sheet. In particular, a cold-rolled steel sheet (thin steel sheet) having a thickness of 0.5 mm to 2.6 mm may contain many inclusion groups aligned in a dot-sequence manner over a length of 300 μm or more at its mid-thickness part, which would induce major adverse effects on the delayed fracture properties. It is thus important to reduce such inclusion groups.

ii) In the case of a cold-rolled steel sheet being subjected to annealing after cold rolling, unlike the thick steel plates shown in PTLs 2 to 4, carbides mainly composed of Fe, such as cementite, coagulate and coarsen during annealing and partly remain undissolved, adversely affecting the delayed fracture resistance at a sheared end face. For this reason, it is also important to reduce such carbides mainly composed of Fe.

iii) To reduce groups of coarse inclusions as mentioned above, it is important to optimize the contents of N, S, O, and Mn in steel (and the contents of Nb and Ti, if contained) and the slab reheating temperature. To reduce the aforementioned carbides mainly composed of Fe and remaining in an undissolved state, it is important to optimize the annealing conditions for continuous annealing (CAL).

iv) In press forming, a steel sheet (coil) may be subjected to press forming while being continuously taken out at a shearing machine or the like. To ensure that all actual parts manufactured through such forming process reliably exhibit excellent delayed fracture resistance, it is important to reduce the amount of sheet thickness variation Δt of the steel sheet.

In other words, when a steel sheet (coil) is subjected to press forming while being continuously taken out, delayed fracture may occur with a fixed probability in some of the resulting parts. The reason is that as long as the sheet thickness variation is large, the ratio of gap to sheet thickness (namely, clearance) is subject to variation even if the gap in the shearing machine is constant, and this would cause a secondary sheared face or a burr to form in the steel sheet, leading to a degradation in the quality of the sheared end face. Therefore, to ensure that actual parts obtained from a steel sheet through cold press forming stably exhibit excellent delayed fracture resistance, it is necessary not only to reduce the above-mentioned groups of coarse inclusions and cementite remaining in an undissolved state, but also to guarantee the quality of a sheared end face by precisely controlling the thickness of the steel sheet.

The present disclosure is based on the above discoveries and further studies.

Specifically, the primary features of the disclosure can be summarized as follows:

1. A cold-rolled steel sheet comprising: a chemical composition that contains (consists of), in mass %, C: 0.15% or more and 0.40% or less, Si: 1.5% or less, Mn: 0.9% to 1.7%, P: 0.03% or less, S: less than 0.0020%, sol. Al: 0.2% or less, N: less than 0.0055%, O: 0.0025% or less, and the balance consisting of Fe and incidental impurities, and that satisfies a relation expressed by:

$$5[\%\ S]+[\%\ N]<0.0115 \quad (1),$$

where [% S] and [% N] denote contents in mass % of S and N in steel, respectively; a microstructure in which tempered martensite and bainite are contained in a total area ratio of 95% or more and 100% or less with respect to a whole volume of the microstructure, a number of inclusion groups having a total length in the rolling direction of more than 120 μm is at most 0.8/mm$^2$, the inclusion groups being formed by one or more inclusion particles, the one or more inclusion particles having a major axis length of 0.3 μm or more and extending and/or distributed in a dot-sequence manner along a rolling direction, and in the case of an inclusion group being formed by two or more inclusion particles, the two or more inclusion particles are spaced apart from one another by 30 μm or less, a number of carbides mainly composed of Fe that have an aspect ratio of 2.5 or less and a major axis length of 0.20 μm or more and 2 μm or less is at most 3,500/mm$^2$, a number of carbides that are distributed in the tempered martensite and/or in the bainite and that have a diameter of 10 nm to 50 nm is at least $0.7\times10^7$/mm$^2$, and prior γ grains have a mean grain size of 18 μm or less; a sheet thickness of 0.5 mm to 2.6 mm; and a tensile strength of 1,320 MPa or more.

2. The cold-rolled steel sheet according to 1., wherein an amount of sheet thickness variation in the rolling direction is 300 μm or less.

3. The cold-rolled steel sheet according to 1. or 2., wherein the chemical composition further contains, in mass %, B: 0.0002% or more and less than 0.0035%.

4. The cold-rolled steel sheet according to any one of 1. to 3., wherein the chemical composition further contains, in mass %, either or both of Nb: 0.002% to 0.08% and Ti: 0.002% to 0.12%.

5. The cold-rolled steel sheet according to any one of 1. to 4., wherein the chemical composition further contains, in mass %, either or both of Cu: 0.005% to 1% and Ni: 0.01% to 1%.

6. The cold-rolled steel sheet according to any one of 1. to 5., wherein the chemical composition further contains, in mass %, one or more selected from the group consisting of Cr: 0.01% to 1.0%, Mo: 0.01% or more and less than 0.3%, V: 0.003% to 0.5%, Zr: 0.005% to 0.2%, and W: 0.005% to 0.2%.

7. The cold-rolled steel sheet according to any one of 1. to 6., wherein the chemical composition further contains, in mass %, one or more selected from the group consisting of Ca: 0.0002% to 0.0030%, Ce: 0.0002% to 0.0030%, La: 0.0002% to 0.0030%, and Mg: 0.0002% to 0.0030%.

8. The cold-rolled steel sheet according to any one of 1. to 7., wherein the chemical composition further contains, in mass %, either or both of Sb: 0.002% to 0.1% and Sn: 0.002% to 0.1%.

9. A method for manufacturing a cold-rolled steel sheet, comprising: hot rolling a steel slab having the chemical composition as recited in any one of 1. and 3. to 8. with a slab reheating temperature of higher than 1,200° C. to obtain a hot-rolled steel sheet; then cold rolling the hot-rolled steel sheet with a rolling reduction of 20% to 75% to obtain a cold-rolled steel sheet having a sheet thickness of 0.5 mm to 2.6 mm; then subjecting the cold-rolled steel sheet to continuous annealing, in which the cold-rolled steel sheet is: subjected to soaking with an annealing temperature of higher than 850° C. and no higher than 910° C. for a duration of more than 300 seconds and no more than 900 seconds; then cooled from 680° C. or higher to 260° C. or lower at a mean cooling rate of 70° C./s or higher; then optionally reheated; and then retained in a temperature range of 150° C. to 260° C. for 20 seconds to 1,500 seconds.

10. The method according to 9., wherein the hot rolling comprises: finish rolling the steel slab with a finisher delivery temperature of 840° C. to 950° C.; then cooling the hot-rolled steel sheet to 700° C. or lower at a cooling rate of 40° C./s or higher; then retaining the hot-rolled steel sheet at a temperature range of 600° C. to 700° C. for 4 seconds or more; then cooling the hot-rolled steel sheet to a temperature range of 500° C. to 630° C.; and then coiling hot-rolled the steel sheet.

Advantageous Effect

According to the disclosure, a cold-rolled steel sheet that has a sheet thickness of 0.5 mm to 2.6 mm and a tensile strength (TS) as high as 1,320 MPa or more, and that is excellent in delayed fracture resistance, particularly delayed fracture resistance at a sheared end face, can be obtained. Since the cold-rolled steel sheet disclosed herein is suitable for cold press forming applications involving shearing and punching, it is advantageous in increasing the strength and reducing the weight of parts, and cost effective.

DETAILED DESCRIPTION

The following describes the present disclosure in detail. Firstly, the chemical composition of the cold-rolled steel sheet according to the disclosure will be explained. The % representations below indicating the chemical composition are in "mass %" unless stated otherwise.

C: 0.15% to 0.40%

C is an element for improving hardenability, and is contained in steel from the perspectives of guaranteeing a predetermined area ratio of tempered martensite and/or bainite, increasing the strength of tempered martensite and bainite, and satisfying the relation of TS≥1,320 MPa. C also has the effect of generating fine carbides as hydrogen trap sites in tempered martensite and bainite. If the C content is less than 0.15%, it is not possible to obtain a predetermined strength while maintaining excellent delayed fracture resistance. On the other hand, if the C content exceeds 0.40%, the strength excessively increases, making it difficult to obtain sufficient delayed fracture resistance. Therefore, the C content is set to 0.15% to 0.40%. From the perspective of satisfying the relation of TS≥1,470 MPa while maintaining excellent delayed fracture resistance, it is desirable that the C content be more than 0.18%.

Si: 1.5% or Less

Si is an element that has a solid solution strengthening effect. When a steel sheet is tempered in a temperature range of 200° C. or higher, Si suppresses formation of film-like carbides and contributes to improvement of delayed fracture resistance. Si also reduces Mn segregation at the mid-thickness part of the steel sheet, and contributes to suppression of MnS formation. Furthermore, Si contributes to suppression of decarburization and deboronization that would be caused by oxidation of the surface layer part of the steel sheet during continuous annealing. No lower limit is placed on the Si content, yet in order to obtain the above effect sufficiently, a preferred Si content is 0.02% or more. On the other hand, excessively increasing the Si content leads to increased segregation, causing delayed fracture resistance to deteriorate. Such an excessively high Si content may also cause an increase in rolling load or a decrease in toughness in hot rolling and cold rolling. Therefore, the Si content is set to 1.5% or less. The Si content may be 0%.

Mn: 0.9% to 1.7%

Mn is added to steel for improving its hardenability and guaranteeing a predetermined area ratio of tempered martensite and/or bainite. Mn also has the effect of fixing S in steel as MnS and suppressing hot shortness. If the Mn content is less than 0.9%, ferrite forms in a surface layer part of the steel sheet, causing the delayed fracture resistance at a sheared end face to markedly deteriorate. To suppress the formation of ferrite in a region ranging from a position of one-fourth the sheet thickness of the steel sheet to the mid-thickness part, the Mn content needs to be 0.9% or more. However, Mn particularly promotes the formation and coarsening of MnS at the mid-thickness part, and a Mn content exceeding 1.7% increases the number and size of huge inclusion groups at the mid-thickness part, leading to a remarkable degradation in the delayed fracture resistance at a sheared end face. Therefore, the Mn content is set to 0.9% to 1.7%. From the perspectives of further reducing coarse MnS at the mid-thickness part and improving delayed fracture resistance, the Mn content is preferably 0.9% or more and 1.4% or less.

P: 0.03% or Less

P is an element for strengthening steel. If its content is high, however, delayed fracture resistance and spot weldability are significantly deteriorated. Therefore, the P content is set to 0.03% or less. The P content is preferably 0.01% or less. Although no lower limit is placed on the P content, an industrially feasible lower limit at present is around 0.003%.

S: Less than 0.0020%

The content of S needs to be strictly controlled as S would otherwise greatly hamper the delayed fracture resistance at a sheared end face through formation of MnS, TiS, Ti(C,S), and the like. In particular, in the hot rolling MnS is stretched as it is rolled, while in the cold rolling MnS is stretched as it is pulverized. In the final product, MnS will be as long as 80 μm to 400 μm. For such a thin steel sheet as the cold-rolled steel sheet disclosed herein, for example, the thickness of the cast slab ranges from about 180 mm to about 250 mm, and the thickness of the steel sheet after final annealing ranges from 0.5 mm to 2.6 mm. Thus, the cumulative rolling reduction would be as high as about 99%. In a thin steel sheet, the elongation ratio in the rolling direction reaches 5 to 10 times that for a thick steel plate, and the adverse effect of MnS becomes even more pronounced, and more serious at a sheared end face. In particular, since all regions are exposed in the sheet thickness direction at a sheared end face, coarse MnS present in a Mn segregation region in the mid-thickness part would particularly degrade the delayed fracture resistance when it forms a huge inclusion group. In addition, TiS and Ti(C,S) often precipitate in combination with or in close proximity to MnS, and form a very coarse inclusion group together with MnS. To alleviate the adverse effect of such inclusion group, the S content needs to be less than 0.0020%. The S content is preferably 0.0014% or less, more preferably 0.0009% or less, and still more preferably 0.0004% or less. Although no lower limit is placed on the S content, an industrially feasible lower limit at present is around 0.0002%.

Sol. Al: 0.2% or Less sol. Al is added to cause sufficient deoxidization and to reduce inclusions in steel. For stable deoxidization, the sol. Al content is desirably 0.01% or more. If the sol. Al content exceeds 0.2%, however, carbides mainly composed of Fe that are produced during the coiling after the hot rolling, such as cementite, hardly dissolve during the subsequent annealing, and the delayed fracture resistance deteriorates. Therefore, the sol. Al content is set to 0.2% or less.

N: Less than 0.0055%

N is an element that forms nitrides such as TiN, (Nb,Ti)(C,N), AlN, or the like and carbonitride-based inclusions in steel, deteriorating the delayed fracture resistance through the formation thereof. In general, the aspect ratio of such inclusions is about 1 to 5, the degree of extension is smaller than that of MnS, and the major axis length is 1 μm to 15 μm, which is also smaller than that of MnS. As such, these inclusions alone have a small influence on delayed fracture, yet some of them are formed in a dot-sequence manner in combination with MnS to produce a huge inclusion group, thereby promoting the adverse effect of MnS and degrading the delayed fracture resistance. In order to prevent deterioration of delayed fracture resistance due to such adverse effect of MnS, it is necessary to set the N content to less than 0.0055%. The N content is preferably less than 0.0045%. Although no lower limit is placed on the N content, an industrially feasible lower limit at present is around 0.0006%.

O: 0.0025% or Less

O is an element that forms oxide-based inclusions such as $Al_2O_3$, $SiO_2$, CaO, MgO, or the like having a diameter of 1 μm to 20 μm in steel, deteriorating the delayed fracture resistance through the formation thereof. These inclusions cause deterioration of the smoothness of a fracture surface formed by shearing and an increase in local residual stress. Thus, such inclusions alone adversely affect the delayed fracture resistance. To mitigate such adverse effects on the delayed fracture resistance, the O content needs to be 0.0025% or less. Although no lower limit is placed on the O content, an industrially feasible lower limit at present is around 0.0005%.

5[% S]+[% N]: Less than 0.0115%

As described above, S and N respectively form inclusions, like nitrides such as MnS and carbonitrides such as TiN, (Nb,Ti)(C,N), AlN, or the like, and these inclusions form a large inclusion group when extended in the rolling direction and aligned in a dot-sequence manner. In order to prevent the deterioration of the delayed fracture resistance at a sheared end face, it is necessary to reduce such inclusions. To this end, the following condition needs to be satisfied: 5[% S]+[% N] is less than 0.0115%. The result of 5[% S]+[% N] is preferably less than 0.0100% and more preferably less than 0.0080%. Although no lower limit is placed on the result, an industrially feasible lower limit is around 0.0010%. As used herein, [% S] and [% N] denote contents in mass % of S and N in steel, respectively.

In addition to the basic components described above, the cold-rolled steel sheet may contain the following elements as appropriate.

B: 0.0002% or More and Less than 0.0035%

B is an element for improving the hardenability of steel, and has the advantage of producing tempered martensite and bainite in a predetermined area ratio even when the Mn content is small. To obtain this effect, the B content is preferably 0.0002% or more, and more preferably 0.0005% or more. From the perspective of fixing N, it is desirable to add B in combination with 0.002% or more of Ti. On the other hand, a B content of 0.0035% or more not only causes saturation of the effect but also delays the dissolution of cementite during annealing, and therefore carbides mainly composed of Fe such as undissolved cementite will remain, causing the delayed fracture resistance at a sheared end face to deteriorate. Therefore, the B content is preferably 0.0002% or more and less than 0.0035%.

Nb: 0.002% to 0.08%

Nb contributes to improvement of strength and delayed fracture resistance as it acts to cause refinement of prior γ grains and thus reduce the size of blocks, variant regions in one Bain zone, and the like, which are internal structural units of tempered martensite and bainite. Nb also contributes to improvement of strength and delayed fracture resistance as it acts to form fine Nb-based carbides/carbonitrides as hydrogen trap sites. In view of this, the Nb content is preferably 0.002% or more. However, excessively adding Nb causes an increase in the amount of coarse Nb-based precipitates such as NbN, Nb(C,N), and (Nb,Ti)(C,N) that will remain undissolved during heating of the slab in the hot rolling, and thus deteriorates the delayed fracture resistance at a sheared end face. Therefore, the Nb content is desirably 0.08% or less.

Ti: 0.002% to 0.12%

Ti contributes to improvement of strength and delayed fracture resistance as it acts to cause refinement of prior γ grains and thus reduce the size of blocks, variant regions in one Bain zone, and the like, which are internal structural units of tempered martensite and bainite. Ti also contributes to improvement of strength and delayed fracture resistance as it acts to form fine Ti-based carbides/carbonitrides as hydrogen trap sites. Ti also contributes to improvement of castability. In view of this, the Ti content is desirably 0.002% or more. However, excessively adding Ti causes an increase in the amount of coarse Ti-based precipitates such as TiN, Ti(C,N), Ti(C,S), and TiS that will remain undissolved during heating of the slab in the hot rolling, and thus deteriorates the delayed fracture resistance at a sheared end face. Therefore, the Ti content is desirably 0.12% or less.

Cu: 0.005% to 1%

Cu has the effect of improving corrosion resistance in environments in which automobiles are used, and suppressing penetration of hydrogen into the steel sheet when its corrosion products cover the surface. Cu is an element that is included in raw materials obtained from scrap metal. By permitting inclusion of Cu, it is possible to use recycled materials as feedstock and to reduce manufacturing costs. In view of this, the Cu content is preferably 0.005% or more. From the perspective of improving delayed fracture resistance, a more desirable Cu content is 0.05% or more. However, excessively adding Cu causes surface defects, and hence the Cu content is desirably 1% or less.

Ni: 0.01% to 1%

Ni is an element that acts to improve corrosion resistance, as is the case with Cu. Ni also has the effect of suppressing surface defects that are likely to occur when Cu is added to the steel. Therefore, the Ni content is desirably 0.01% or more. However, excessively adding Ni causes an increase in the non-uniformity of scale formation in the heating furnace, which instead leads to surface defects. This also results in a rise in cost. Therefore, the Ni content is set to 1% or less.

Cr: 0.01% to 1.0%

Cr has the effect of improving the hardenability of steel. To obtain this effect, the Cr content is preferably 0.01% or more. On the other hand, a Cr content exceeding 1.0% not only causes saturation of the effect but also delays the dissolution of cementite during annealing, and as a consequence carbides mainly composed of Fe such as undissolved cementite will remain, causing the delayed fracture resistance at a sheared end face to deteriorate. Such a high Cr content also deteriorates pitting corrosion resistance and chemical convertibility. Therefore, the Cr content is desirably 0.01% to 1.0%. If the Cr content exceeds 0.2%, the delayed fracture resistance, pitting corrosion resistance, and chemical convertibility may be deteriorated. To prevent this, the Cr content is preferably 0.2% or less.

Mo: 0.01% or More and Less than 0.3%

Mo is added to the steel in order to obtain the effect of improving the hardenability of steel and the effect of further improving delayed fracture resistance by formation of fine carbides containing Mo as hydrogen trap sites and by refinement of tempered martensite. To obtain this effect, the Mo content is desirably 0.01% or more. However, a Mo content of 0.3% or more causes noticeable deterioration in chemical convertibility. Therefore, the Mo content is desirably 0.01% or more. The Mo content is desirably less than 0.3%.

V: 0.003% to 0.5%

V is added to the steel in order to obtain the effect of improving the hardenability of steel and the effect of further improving delayed fracture resistance by formation of fine carbides containing V as hydrogen trap sites and by refinement of tempered martensite. To obtain this effect, the V content is desirably 0.003% or more. However, a V content exceeding 0.5% causes noticeable deterioration in castability. Therefore, the V content is desirably 0.003% or more. The V content is desirably 0.5% or less.

Zr: 0.005% to 0.2%

Zr contributes to improvement of strength and delayed fracture resistance as it acts to cause refinement of prior γ grains and thus reduce the size of blocks, variant regions in one Bain zone, and the like, which are internal structural units of tempered martensite and bainite. Zr also contributes to improvement of strength and delayed fracture resistance as it acts to form fine Zr-based carbides/carbonitrides as hydrogen trap sites. In view of this, the Zr content is desirably 0.005% or more. However, excessively adding Zr causes an increase in the amount of coarse precipitates such as ZrN and ZrS that will remain undissolved during heating of the slab in the hot rolling, thereby causing the delayed fracture resistance at a sheared end face to deteriorate. Therefore, the Zr content is desirably 0.2% or less.

W: 0.005% to 0.2%

W contributes to improvement of strength and delayed fracture resistance as it acts to cause refinement of prior γ grains and thus reduce the size of blocks, variant regions in one Bain zone, and the like, which are internal structural units of tempered martensite and bainite. W also contributes to improvement of strength and delayed fracture resistance as it acts to form fine W-based carbides/carbonitrides as hydrogen trap sites. In view of this, the W content is desirably 0.005% or more. However, excessively adding W causes an increase in the amount of coarse precipitates that will remain undissolved during heating of the slab in the hot rolling, thereby causing the delayed fracture resistance at a sheared end face to deteriorate. Therefore, the W content is desirably 0.2% or less.

Ca: 0.0002% to 0.0030%

Ca fixes S as CaS, and contributes to improvement of delayed fracture resistance. Therefore, the Ca content is preferably 0.0002% or more. However, a high Ca content degrades surface quality and bendability. Therefore, the Ca content is desirably 0.0030% or less.

Ce: 0.0002% to 0.0030%

Ce fixes S, and contributes to improvement of delayed fracture resistance, as is the case with Ca. Therefore, the Ce content is preferably 0.0002% or more. However, a high Ce content degrades surface quality and bendability. Therefore, the Ce content is desirably 0.0030% or less.

La: 0.0002% to 0.0030%

La fixes S, and contributes to improvement of delayed fracture resistance, as is the case with Ca. Therefore, the La content is preferably 0.0002% or more. However, a high La content degrades surface quality and bendability. Therefore, the La content is desirably 0.0030% or less.

Mg: 0.0002% to 0.0030%

Mg fixes O as MgO, and contributes to improvement of delayed fracture resistance. Therefore, the Mg content is preferably 0.0002% or more. However, a high Mg content degrades surface quality and bendability. Therefore, the Mg content is desirably 0.0030% or less.

Sb: 0.002% to 0.1%

Sb suppresses oxidation and nitriding of the surface layer part of the steel sheet, and suppresses the consequent reduction of C and B. As the reduction of C and B is thus suppressed, the formation of ferrite is reduced in the surface layer part of the steel sheet, which fact contributes to improvement of strength and delayed fracture resistance. In view of this, the Sb content is desirably 0.002% or more. However, if the Sb content is more than 0.1%, castability degrades, and Sb segregates to prior γ grain boundaries, leading to deterioration in the delayed fracture resistance at a sheared end face. Therefore, the Sb content is desirably 0.1% or less.

Sn: 0.002% to 0.1%

Sn suppresses oxidation and nitriding of the surface layer part of the steel sheet, and suppresses the consequent reduction of C and B. As the reduction of C and B is thus suppressed, the formation of ferrite is reduced in the surface layer part of the steel sheet, which fact contributes to improvement of strength and delayed fracture resistance. In view of this, the Sn content is desirably 0.002% or more. However, if the Sn content is more than 0.1%, castability degrades, and Sn segregates to prior γ grain boundaries, leading to deterioration in the delayed fracture resistance at a sheared end face. Therefore, the Sn content is preferably 0.1% or less.

The balance other than the above components consists of Fe and incidental impurities.

As described above, the cold-rolled steel sheet according to the disclosure has such a chemical composition that contains the above-described basic components and optional elements such as B, Nb, Ti, Cu, Ni, Cr, Mo, V, Zr, W, Ca, Ce, La, Mg, Sb, and Sn, with the balance consisting of Fe and incidental impurities.

The following provides a description of a microstructure of the cold-rolled steel sheet according to the disclosure.

The Total Area Ratio of Tempered Martensite and Bainite with Respect to the Whole Volume of the Microstructure is 95% or More (Inclusive of 100%).

To attain both strength as high as TS≥1,320 MPa and excellent delayed fracture resistance, the total area ratio of tempered martensite and bainite with respect to the whole volume of the microstructure is set to 95% or more. Below this range, there will be increased ferrite, residual γ (retained austenite), or martensite, causing delayed fracture resistance to deteriorate. The total area ratio of tempered martensite and bainite with respect to the whole volume of the microstructure may be 100%.

The remainder of the microstructure other than the tempered martensite and bainite are formed by, for example, ferrite, residual γ, and martensite, the total amount of which allowable in this disclosure is up to 5%. The total amount may be 0%.

The Number of Inclusion Groups Having a Total Length in the Rolling Direction of More than 120 μm is at Most $0.8/mm^2$, the Inclusion Groups being Formed by One or More Inclusion Particles, the One or More Inclusion Particles Having a Major Axis Length of 0.3 μm or More and Extending and/or Distributed in a Dot-Sequence Manner Along a Rolling Direction, and in the Case of an Inclusion Group being Formed by Two or More Inclusion Particles, the Two or More Inclusion Particles are Spaced Apart from One Another by 30 μm or Less.

To improve the delayed fracture resistance at a sheared end face, it is necessary to sufficiently reduce inclusion groups composed of MnS, oxides, nitrides, and the like, as described above, in a region ranging from the surface layer part to the mid-thickness part, particularly in the mid-thickness part. To suppress the occurrence of cracks originating from a sheared end face, even for those parts formed from high-strength steel with TS≥1,320 MPa, it is necessary to reduce the number of such inclusion groups to at most $0.8/mm^2$. The number of such inclusion groups is preferably less than $0.6/mm^2$. The number of such inclusion groups may be zero per square millimeter.

The Number of Carbides Mainly Composed of Fe that have an Aspect Ratio of 2.5 or Less and a Major Axis Length of 0.20 μm or More and 2 μm or Less is at Most $3,500/mm^2$.

Upon a detailed study of the relation between the delayed fracture resistance at a sheared end face and inclusion particles, we found that under conventionally specified annealing conditions, carbides mainly composed of Fe such as cementite are not completely dissolved and there will remain a certain amount of carbides undissolved. Our study also revealed that such undissolved carbides mainly composed of Fe, specifically, coarse carbides mainly composed of Fe that have an aspect ratio of 2.5 or less and a major axis length of 0.20 μm or more and 2 μm or less adversely affect the delayed fracture resistance at a sheared end face. As described above, these coarse carbides have an aspect ratio of 2.5 or less and a major axis length of 0.20 μm or more and 2 μm or less, and are apparently different from fine carbides in grains precipitated during tempering or from film-like coarse precipitates at grain boundaries.

Therefore, it is necessary to reduce the number of such carbides mainly composed of Fe to at most $3,500/mm^2$. The number of such carbides is preferably at most $2,000/mm^2$. The number of such carbides mainly composed of Fe may be zero per square millimeter.

As will be described later, fine carbides in the grains precipitated during tempering and film-like coarse precipitates at grain boundaries do not appear dark in an SEM backscattered electron image, and are thus distinguishable from carbides mainly composed of Fe that appear dark.

Mean Grain Size of Prior γ Grains is 18 μm or Less.

To attain both strength as high as TS≥1,320 MPa and excellent delayed fracture resistance, it is necessary to refine prior γ grains. As prior γ grains coarsen, grain boundary fracture occurs easily and the internal structures of tempered martensite and bainite are coarsened, which tends to cause pseudo cleavage fracture. Strength also decreases. Therefore, the mean grain size of prior γ grains is adjusted to be 18 μm or less. Although no lower limit is placed on the mean grain size, a preferred lower limit is around 2 μm.

The Number of Carbides that are Distributed in Tempered Martensite and/or in Bainite and that have a Diameter of 10 nm to 50 nm is at Least $0.7\times10^7/mm^2$.

Fine carbides distributed in tempered martensite and/or in bainite are carbides mainly composed of Fe that are precipitated during tempering. These carbides can increase the smoothness of a fracture surface resulting from shearing and can be utilized as hydrogen trap sites in a hydrogen attack environment. Therefore, the number of carbides that are distributed in tempered martensite and/or in bainite and that have a diameter of 10 nm to 50 nm is adjusted to be at least $0.7\times10^7/mm^2$. Although no upper limit is placed on the number of such carbides, a preferred upper limit is around $7\times10^7/mm^2$. Beyond this range, the strength is excessively increased, causing deterioration of the delayed fracture resistance.

The following provides a description of analysis and measurement of the above-described microstructure.

Firstly, the total area ratio of tempered martensite and bainite, as well as the area ratio of the remainder of the microstructure, including ferrite, residual γ, martensite, and the like, can be determined by the following procedure: an L-cross section (a vertical section parallel to the rolling direction) of a steel sheet is polished and etched with nital, and then four locations are observed at 2,000 times magnification under an SEM (scanning electron microscope), at a position of one-fourth the sheet thickness of the steel sheet, to capture microstructure micrographs for image analysis. In this case, tempered martensite and bainite refer to such microstructural constituents that appear gray under the SEM and that involve precipitation of fine carbides. Depending on the plane orientation of block grains and the degree of etching, internal carbides may be less apparent, and in that case adequate etching will be required to confirm the internal carbides.

On the other hand, ferrite appears as regions that exhibit dark contrast under the SEM, while residual γ and martensite (martensite neither tempered when retained for a certain period at approximately 150° C. or higher, nor undergoing self-tempering during continuous cooling) appear as nearly white, gray regions. These regions contain almost no carbides of the size observable under the SEM. Although the tempered martensite and bainite contain trace amounts of carbides, nitrides, sulfides, and oxides, it is difficult to exclude them. Therefore, the area ratio of regions including these regions is used as the area ratio of tempered martensite and bainite.

Further, the number (distribution density) per square millimeter of inclusion groups having a total length in the rolling direction of more than 120 μm can be determined by counting the number of inclusion groups in SEM images recorded continuously through SEM imaging of an L-cross section (a vertical section parallel to the rolling direction) being polished without subsequent etching, to observe at least 2 $mm^2$, preferably 8 $mm^2$, of a region ranging from a position of ⅕ to ⅘ of the thickness of the steel sheet, that is, a ⅕ thickness position from the surface of the steel sheet, across the mid-thickness part to a position of ⅘ of the thickness of the steel sheet. These inclusion groups are formed by one or more inclusion particles, the one or more inclusion particles having a major axis length of 0.3 μm or more and extending and/or distributed in a dot-sequence manner along the rolling direction. In the case of an inclusion group being formed by two or more inclusion particles, the two or more inclusion particles are spaced apart from one another by 30 μm or less.

The reason why the above-mentioned region is measured is because almost no such inclusion group exists near the surface of the steel sheet. In other words, there is less segregation of Mn and S in the vicinity of the surface of the steel sheet, and this means that sufficiently high temperature is reached during slab reheating, allowing for sufficient dissolution of Mn and S and thus hindering their precipitation.

The SEM images are preferably backscattered electron images. The imaging magnification may be 500 to 2,000 times. However, when the size of or the distance between inclusion particles is difficult to accurately measure at 500 to 2,000 times magnification, the magnification may be increased as appropriate to 3,000 to 10,000 times to define the size of individual inclusion particles.

As used herein, the distance between inclusion particles refers to the distance between the surfaces of the closest inclusion particles having a major axis length of 0.3 μm or more. Since inclusions extending in the rolling direction are targeted here, the measurement of interparticle distance is limited to the rolling direction or directions of 30°± the rolling direction.

In the case of the inclusion group being formed by two or more inclusion particles, the total length in the rolling direction of the inclusion group is a distance in the rolling direction between the rolling-direction outer ends of inclusion particles located at opposite ends in the rolling direction of the inclusion group. Alternatively, in the case of the inclusion group being formed by a single inclusion particle, the total length in the rolling direction of the inclusion group is the length in the rolling direction of the inclusion particle.

The individual inclusion particles forming the inclusion group are mainly Mn—, Ti—, Zr—, Ca—, or REM-based sulfides, Al—, Ca—, Mg—, Si—, or Na-based oxides, or Ti—, Zr—, Nb—, or Al-based nitrides, or Ti—, Nb—, Zr—, or Mo-based carbides. Many of these inclusion groups are such inclusion groups that are produced in casting and then remain undissolved during heating of the slab, and the remainder are such inclusion groups that re-precipitate in combination therewith or in close proximity thereto during the subsequent hot rolling, coiling, and annealing. These inclusions do not include carbides mainly composed of Fe.

In addition, the number of carbides mainly composed of Fe, per square millimeter, that have an aspect ratio of 2.5 or less and a major axis length of 0.20 μm or more and 2 μm or less (hereinafter, also referred to as "carbides A") can be determined by observing, at 2,000 times magnification under the SEM, five locations in an L-cross section (a vertical section parallel to the rolling direction) of the steel sheet being polished without subsequent etching or with only minor etching with nital, at a position of one-fourth the sheet thickness of the steel sheet.

In this case, the SEM images are preferably backscattered electron images and carbides A are particles that appear dark. It is noted here that carbides that are distributed in tempering martensite and/or in bainite (hereinafter, also referred to as carbides B) and that have a diameter of 10 nm to 50 nm, which will be described later, can be measured separately as they do not appear dark in backscattered electron images.

In addition, when the size of carbides A is difficult to accurately measure at 2,000 times magnification, the magnification may be increased to 3,000 to 10,000 times as appropriate to ascertain the size of carbides A. Whether the carbides are mainly composed of Fe can be determined by elemental analysis of the particles with EDX.

The mean grain size of prior γ grains can be determined by averaging the results of measuring the particles size of prior γ grains at any four locations in an L-cross section (a vertical section parallel to the rolling direction) of the steel sheet being polished with subsequent etching with a chemical solution for removing prior γ grain boundaries (e.g., a saturated picric acid aqueous solution or a ferric chloride solution), at 400 times magnification under an optical microscope, at a position of one-fourth the sheet thickness of the steel sheet.

In addition, the number (distribution density) of carbides that are distributed in tempered martensite and/or in bainite and that have a diameter of 10 nm to 50 nm (hereinafter, also referred to as carbides B) can be determined by observing four locations in SEM secondary electron images at 10,000 times magnification under the SEM as enlarged at 25,000 times magnification, at a position of one-fourth the sheet thickness of the sample etched with nital used in the measurement of the area ratio of each phase. In this case, carbides B are particles that are present in martensite or bainite grains and that appear white. The diameter of carbides B can be determined as $(a \times b)^{0.5}$, which is an equivalent circle diameter when a is the major axis length and b is the minor axis length.

In the cold-rolled steel sheet disclosed herein, the sheet thickness and the tensile strength TS are set in the ranges given below.

Sheet Thickness: 0.5 mm to 2.6 mm.

As the sheet thickness increases, it is difficult to perform bending necessary for producing automotive parts. For example, a sheet thickness greater than 2.6 mm cannot yield a bending angle of 90° or more with a bending radius of 5 mm or less, making applications to automotive parts difficult. On the other hand, it is extremely difficult to manufacture a high-strength steel sheet with TS≥1,320 MPa or more by reducing its thickness to less than 0.5 mm because of the problem of increasing rolling load. Therefore, the sheet thickness is set in a range of 0.5 mm to 2.6 mm.

Tensile Strength TS: 1,320 MPa or More

The delayed fracture resistance at a sheared end face deteriorates particularly when the tensile strength of the steel sheet is 1,320 MPa or more. Therefore, steel sheets with tensile strength of 1,320 MPa or more are targeted here.

In the cold-rolled steel sheet disclosed herein, it is also preferable to control the amount of sheet thickness variation in the rolling direction Δt to fall within a predetermined range.

The Amount of Sheet Thickness Variation in the Rolling Direction Δt: 300 μm or Less In press forming, a steel sheet (coil) may be subjected to cold press forming whereby it is continuously cut out at a shearing machine or the like. Some of the actual parts manufactured through such forming process may suffer delayed fracture with a fixed probability. As a result of further investigation on this phenomenon, we revealed that in a press forming process in which several hundreds to several thousands of press cycles are performed per day, as long as the sheet thickness variation is large, the ratio of gap to sheet thickness (namely, clearance) is subject to variation even if the gap in the shearing machine is constant, and this would cause a secondary shear surface or a burr to form in the steel sheet and accelerate the wear of the press mold, leading to deterioration of the delayed fracture resistance at a sheared end face. We also found that the amount of spring back varies with changes in the clearance of the press mold, and this variation would increase the residual stress in parts, leading to deterioration in the delayed fracture resistance of the parts after subjection to press forming.

The stability of the delayed fracture resistance of the parts produced by cold press forming whereby a steel sheet (coil) is continuously taken out at a shearing machine or the like is remarkably improved if the amount of sheet thickness variation in the rolling direction Δt of the steel sheet is controlled to be 300 μm or less. Therefore, Δt is preferably adjusted to be 300 μm or less. Δt is more preferably adjusted to be 250 μm or less.

It is noted here that Δt refers to a difference between the maximum and minimum sheet thicknesses as measured continuously at locations in the widthwise central part or at locations of one-fourth the width of a steel sheet (coil) over its entire length along the rolling direction (the longitudinal direction of the coil). For a coil divided in the rolling direction, the total length of the coil after division is measured. As sheet thickness variation usually occurs in a serrated pattern with a cycle of about 10 m to about 15 m, the amount of sheet thickness variation (difference between the maximum and minimum) for each location of the coil can be measured by measuring the sheet thickness at every 30 m sections. Δt over the entire length of the coil substantially matches the maximum value of the amount of sheet thickness variation for each location of the coil. For measurement of the sheet thickness, a contactless measuring device such as an X-ray or a laser or a touch-sensitive measuring device such as a micrometer may be used. If continuous measurement is difficult, measurement may be performed at pitches of 1 mm to 70 mm.

Next, a method for manufacturing a cold-rolled steel sheet according to the disclosure will be described below.

The method of manufacturing a cold-rolled steel sheet according to the disclosure comprises: hot rolling a steel slab having the chemical composition as described above with a slab reheating temperature of higher than 1,200° C. to obtain a hot-rolled steel sheet; then cold rolling the hot-rolled steel sheet with a rolling reduction of 20% to 75% to obtain a cold-rolled steel sheet having a sheet thickness of 0.5 mm to 2.6 mm; then subjecting the cold-rolled steel sheet to continuous annealing, in which the cold-rolled steel sheet is: subjected to soaking with an annealing temperature of higher than 850° C. and no higher than 910° C. for a duration of more than 300 seconds and no more than 900 seconds; then cooled from 680° C. or higher to 260° C. or lower at a mean cooling rate of 70° C./s or higher; then optionally reheated; and then retained in a temperature range of 150° C. to 260° C. for 20 seconds to 1,500 seconds.

The hot rolling comprises: finish rolling the steel slab with a finisher delivery temperature of 840° C. to 950° C.; then cooling the hot-rolled steel sheet to 700° C. or lower at a cooling rate of 40° C./s or higher; then retaining the hot-rolled steel sheet at a temperature range of 600° C. to 700° C. for 4 seconds or more; then cooling the hot-rolled steel sheet to a temperature range of 500° C. to 630° C.; and then coiling the hot-rolled steel sheet. These conditions will be described below.

<Hot Rolling>

Slab heating temperature: higher than 1,200° C. A method of hot rolling the steel slab may include, for example, rolling the slab after heating, rolling the slab directly after continuous casting without intermediate heating therebetween, or rolling the slab after continuous casting after subjecting the slab to heat treatment for a short time. In the manufacturing method disclosed herein, however, it is very important that the slab reheating temperature be higher than 1,200° C. The reason is that by setting the slab reheating temperature to be higher than 1,200° C., it becomes possible to facilitate dissolution of sulfides, suppress Mn segregation, and reduce the size and number of inclusion groups as described above. Therefore, the slab reheating temperature is set to be higher than 1,200° C. In addition, the heating rate during slab reheating may be 5° C./min to 15° C./min and the slab soaking time be 30 minutes to 100 minutes.

The ratio, denoted as $\varepsilon 2/\varepsilon 1$, of elongation strain $\varepsilon 2$ along the major axis of an inclusion group of MnS-based inclusions (in the case of fracture, an increase in the major axis length including an increase in the distance between inclusions) to elongation strain $\varepsilon 1$ in steel calculated from the rolling ratio (namely, true strain assuming no change in the width direction) was determined to be 0.60 and 0.65 in the hot rolling and cold rolling, respectively, and elongation was observed in either rolling.

This means that the degree of extension of inclusions can be reduced by setting a lower rolling reduction for cold rolling relative to a rolling reduction for hot rolling, yet the adjustment of rolling reduction is less effective, and the cumulative rolling reduction is dominant. In other words, it is important to reduce the thickness of the cast slab relative to the sheet thickness of the steel sheet after final annealing. However, in practice, thinning the slab will impair the productivity. Thus, the thickness of the cast slab is set in a range of 100 mm to 250 mm. In particular, the thickness of the cast slab is preferably 150 mm or more. The thickness of the cast slab is preferably 200 mm or less. According to a regular method, a cumulative rolling reduction in a temperature range of 950° C. or higher may be from 90% to 98%, while a cumulative rolling reduction in a temperature range of 950° C. or lower including the cold rolling may be from 50% to 92%.

The steel slab is finish rolled with a finisher delivery temperature of 840° C. to 950° C., then cooled to 700° C. or lower at a cooling rate of 40° C./s or higher, then retained in a temperature range of 600° C. to 700° C. for 4 seconds or more, then cooled to a temperature range of 500° C. to 630° C., and then coiled.

To suppress sheet thickness variation of the steel sheet (coil), it is preferable that in the hot rolling the finisher delivery temperature is adjusted to be 840° C. to 950° C., and that after the finish rolling the steel sheet is cooled to a temperature of 700° C. or lower at a cooling rate of 40° C./s or higher, then retained in a temperature range of 600° C. to 700° C. for 4 seconds or more, then cooled to a temperature range of 500° C. to 630° C., and then coiled.

When the C content is 0.15 mass % or more, the start of transformation in the hot rolling is delayed, and hence under normal hot rolling conditions the steel sheet is coiled while leaving a certain amount of non-transformed γ. Therefore, temperature variation in the coil caused by uneven cooling during the hot rolling and the differences in cooling rate among locations in the coil after being coiled lead to non-uniformity in the transformation structure in the longitudinal direction of the coil, namely, in the rolling direction, causing intensity variation in the hot-rolled coil. This causes sheet thickness variation in the longitudinal direction of the coil and deterioration in the delayed fracture resistance of the resulting parts.

To reduce such sheet thickness variation in the longitudinal direction of the coil, it is effective to cool the steel sheet after being finish rolled in the hot rolling to a temperature of 700° C. or lower at a cooling rate of 40° C./s or higher, and to subsequently retain the steel sheet in a transformation nose temperature range of 600° C. to 700° C. for 4 seconds or more. This causes an increase in impact surface pressure of the cooling water, making it possible to keep water from pooling on the steel sheet surface, which would otherwise cause a partial temperature drop in the coil, and to facilitate ferrite transformation, promoting uniform ferrite transformation in the coil.

A more preferred cooling rate is 50° C./s or higher. No upper limit is placed on the cooling rate, yet a preferred upper limit is normally around 250° C./s. The upper limit for the holding time in the temperature range of 600° C. to 700° C. is not particularly limited, yet it is normally about 10 seconds.

Subsequently, coiling the steel sheet in a temperature range of 500° C. to 630° C. can yield a uniform microstructure that is mainly composed of ferrite+pearlite or ferrite+bainite over the entire length of the coil. This results in a hot-rolled coil with small variation in rolling deformation resistance over the entire length, and provides remarkably improved sheet thickness accuracy after the cold rolling. From the perspective of reducing the amount of carbides mainly composed of Fe that have an aspect ratio of 2.5 or less and a major axis length of 0.20 μm or more and 2 μm or less, lower coiling temperature (CT) is preferred; specifically a preferred coiling temperature is 600° C. or lower.

Further, from the perspective of promoting transformation, the finisher delivery temperature FT is preferably set in a range of 840° C. to 950° C. and lowered to a temperature not falling below the $Ar_3$ transformation temperature.

Quenching after the rolling is preferably initiated within 2 seconds after completion of the finish rolling, and cumulative rolling reduction in a temperature range of 930° C. or lower, which is effective in promoting transformation, is preferably set to 20% or more.

Optionally, the resulting coil is then water-cooled and removed from the coiler while rotating it. At this time, it is preferable to minimize the water cooling time; it is more preferable not to carry out water cooling. In the coil coiled in the temperature range of 500° C. to 630° C., transformation will be almost completed when the coil is retained for 60 seconds or more. Thus, from the perspective of suppressing the subsequent surface oxidation, it is preferable to water-cool the coil as it is or to uncoil the coil before cooling with water or gas.

As described above, the steel slab is finish rolled with a finisher delivery temperature of 840° C. to 950° C., then cooled to 700° C. or lower at a cooling rate of 40° C./s or higher, then retained in a temperature range of 600° C. to 700° C. for 4 seconds or more, then cooled to a temperature range of 500° C. to 630° C., and then coiled. This setup allows for reducing the amount of sheet thickness variation in the rolling direction Δt to 300 μm or less.

It is also desirable to perform descaling in order to remove primary and secondary scales generated on the surface of the steel sheet. The descaling is preferably performed under a high impact pressure of 500 MPa or more. This setup allows for reducing the possibility of remaining red scale and the thickness of any secondary scales generated, which enables reduction of oxidation of the steel sheet surface resulting from oxygen in scales being introduced into the steel sheet during coiling in the hot rolling. This may result in a reduction of the thickness of an oxidation layer in the surface layer of the final product, which contributes to improvement of corrosion resistance. It is also possible to prevent reduction of C and B near the surface layer part of the steel sheet due to their oxidation, and to suppress formation of ferrite in the surface layer part during continuous annealing, which will be described later. As a result, the delayed fracture resistance at a sheared end face is also improved.

It is preferable to pickle the hot-rolled coil before cold rolling sufficiently to reduce the remaining scales. From the perspective of load reduction in the cold rolling, hot band annealing may be optionally performed.

<Cold Rolling>

The cold rolling may be performed under a set of conditions, including a rolling reduction of 20% to 75% and a thickness of the steel sheet after subjection to the cold rolling from 0.5 mm to 2.6 mm. Other conditions may be determined according to a regular method.

<Continuous Annealing (CAL)>

The steel sheet after subjection to the cold rolling is subjected to continuous annealing (CAL) in which it is subjected to annealing and tempering treatment, and to optional temper rolling. What is important here is to adjust the steel microstructure to ensure the following:

(1) a predetermined area ratio of tempered martensite and bainite;

(2) reduction of undissolved carbides (carbides mainly composed of Fe that have an aspect ratio of 2.5 or less and a major axis length of 0.20 μm or more and 2 μm or less, in other words, promotion of dissolution of carbides during annealing;

(3) maintenance of fine prior γ grains; and (4) fine dispersion of carbides in tempered martensite and/or in bainite.

Key points to achieve (1) through (4) are:

to perform annealing at a high temperature and for a long duration (for (1) and (2));

to avoid annealing at an excessively high temperature or for an excessively long duration (for (3));

to perform quenching from a high temperature after annealing (for (1)); and to perform tempering for a predetermined time in a specific temperature range (for (4)).

Soaking at a Temperature of Higher than 850° C. and No Higher than 910° C. for a Duration of More than 300 Seconds and No More than 900 Seconds As described above, carbides mainly composed of Fe (Fe-based carbide particles appearing dark in an SEM back-scattered electron image) that have an aspect ratio of 2.5 or less and a major axis length of 0.20 μm or more and 2 μm or less include carbides such as cementite particles remaining undissolved even after annealing. To sufficiently reduce such carbides, it is necessary to perform annealing at a high temperature for a long duration. Specifically, soaking needs to be performed with an annealing temperature of higher than 850° C. and for a duration of more than 300 seconds. On the other hand, an annealing temperature above 910° C. or a soaking time longer than 900 seconds causes prior γ grains to coarsen, which ends up deteriorating the delayed fracture resistance. Therefore, the soaking is performed with an annealing temperature of higher than 850° C. and no higher than 910° C. for a duration of more than 300 seconds and no more than 900 seconds. More preferably, the soaking is performed with an annealing temperature of 870° C. to 900° C. for a duration of 350 seconds to 600 seconds.

Cooling from 680° C. or Higher to 260° C. or Lower at a Mean Cooling Rate of 70° C./s or Higher To reduce the amount of the remainder of the microstructure such as ferrite, residual γ, or martensite and to adjust the total area ratio of tempered martensite and bainite to be 95% or more, it is necessary to cool the steel sheet from 680° C. or higher to 260° C. or lower at a mean cooling rate of 70° C./s or higher. If the cooling start temperature is below 680° C., a large amount of ferrite forms and at the same time carbon concentrates to γ to lower the Ms point, causing an increase in the amount of martensite not subjected to tempering treatment (fresh martensite). At a low cooling rate, upper bainite and lower bainite form, causing an increase in the amount of residual γ and martensite.

The cooling rate is preferably 100° C./s or higher, and more preferably 500° C./s or higher. No upper limit is placed on the cooling rate, yet a normal upper limit is around 2,000° C./s.

Optional Reheating, and Subsequent Retaining in a Temperature Range of 150° C. to 260° C. for 20 Seconds to 1,500 Seconds Carbides that are distributed in tempered martensite and/or in bainite and that have a diameter of 10 nm to 50 nm are carbides that are formed while the steel sheet being retained in a low temperature range after subjection to quenching, and in order for their distribution density to be $0.7\times10^7/mm^2$ or more, it is advantageous to quench the steel sheet to near room temperature and subsequently reheat to and retain in a temperature range of 150° C. to 260° C., or alternatively to control the cooling stop temperature in a range of 150° C. to 260° C. and the holding time in a range of 20 seconds to 1,500 seconds.

When the holding temperature is lower than 150° C. or the holding time is less than 20 seconds, the distribution density of carbides in tempered martensite and/or in bainite becomes insufficient. On the other hand, when the holding temperature is higher than 260° C., coarsening of carbides occurs in prior γ grains and at prior γ grain boundaries, causing the number of fine carbides to decrease.

The holding time is preferably 120 seconds or more. The holding time is preferably 1,200 seconds or less.

After being retained in the temperature range of 150° C. to 260° C. for 20 seconds to 1,500 seconds, the steel sheet is cooled to room temperature. Optionally, the resulting steel sheet may be subjected to temper rolling (skin pass rolling) from the perspective of stabilizing press formability for the purposes of adjustment of surface roughness, planarization of the steel sheet, and so on. In this case, the skin pass elongation rate is preferably 0.1% or more. The skin pass elongation rate is preferably 0.6% or less. In that case, from the perspective of planarization of the steel sheet, it is preferable to perform skin pass rolling with dull rolls and to adjust roughness Ra of the steel sheet to be from 0.8 μm to 1.8 μm.

Examples

Steels labeled as A to AF in Table 1 were prepared by steelmaking and cast into slabs of 130 mm to 230 mm thick. The cast slabs were respectively hot-rolled under the conditions shown in Table 2, with slab reheating temperature (SRT) of 1,100° C. to 1,260° C., soaking time of 60 minutes, and finisher delivery temperature (FT) of 850° C. to 910° C., and subsequently cooled with a mean cooling rate (cooling rate) of 30° C./s to 200° C./s in a temperature range up to 700° C., retained in a temperature range of 620° C. to 730° C. for a holding time of 2 seconds to 10 seconds, then cooled again, and subsequently coiled at a coiling temperature (CT) of 490° C. to 620° C. The obtained hot rolled sheets were respectively pickled and cold-rolled at a rolling reduction of 44% to 72% to obtain cold-rolled steel sheets with a sheet thickness of 0.5 mm to 2.0 mm.

The cold-rolled steel sheets thus obtained were respectively annealed in a continuous annealing line under the conditions shown in Table 2, with annealing temperature (AT) of 850° C. to 910° C. and soaking time of 120 seconds to 960 seconds, and then cooled with a cooling start temperature of 675° C. to 820° C. and a cooling stop temperature in a range of room temperature (R.T.) to 200° C., at a mean cooling rate of 40° C./s to 2,000° C./s in a temperature range from the corresponding cooling start temperature to the corresponding cooling stop temperature, then optionally reheated, and subsequently subjected to tempering treatment in which the steel sheets were respectively retained in a temperature range of 20° C. to 480° C. for a holding time of 60 seconds to 1,500 seconds. Subsequently, the steel sheets were subjected to temper rolling with elongation ratio of 0.1% to obtain final cold-rolled steel sheets.

TABLE 1

| Steel | Chemical composition (mass %) | | | | | | | |
|---|---|---|---|---|---|---|---|---|
| ID | C | Si | Mn | P | S | sol. Al | N | O |
| A | 0.160 | 0.12 | 1.30 | 0.009 | 0.0005 | 0.025 | 0.0032 | 0.0011 |
| B | 0.190 | 0.21 | 1.40 | 0.007 | 0.0010 | 0.035 | 0.0034 | 0.0009 |
| C | 0.221 | 0.08 | 1.00 | 0.007 | 0.0004 | 0.042 | 0.0038 | 0.0007 |
| D | 0.190 | 0.85 | 1.30 | 0.012 | 0.0007 | 0.030 | 0.0029 | 0.0007 |
| E | 0.231 | 0.04 | 0.91 | 0.005 | 0.0004 | 0.021 | 0.0008 | 0.0008 |
| F | 0.218 | 0.22 | 0.95 | 0.007 | 0.0016 | 0.027 | 0.0034 | 0.0009 |
| G | 0.212 | 0.22 | 1.12 | 0.007 | 0.0014 | 0.027 | 0.0032 | 0.0009 |
| H | 0.212 | 0.24 | 1.16 | 0.007 | 0.0009 | 0.022 | 0.0035 | 0.0009 |
| I | 0.225 | 0.20 | 0.90 | 0.007 | 0.0003 | 0.035 | 0.0028 | 0.0009 |
| J | 0.285 | 0.17 | 0.92 | 0.004 | 0.0003 | 0.022 | 0.0030 | 0.0007 |
| K | 0.264 | 0.38 | 0.90 | 0.004 | 0.0003 | 0.022 | 0.0028 | 0.0007 |
| L | 0.242 | 1.50 | 0.90 | 0.006 | 0.0004 | 0.030 | 0.0030 | 0.0007 |
| M | 0.348 | 0.34 | 0.90 | 0.004 | 0.0003 | 0.018 | 0.0020 | 0.0006 |
| N | 0.310 | 1.50 | 0.92 | 0.004 | 0.0003 | 0.024 | 0.0016 | 0.0006 |
| O | 0.210 | 0.22 | 1.69 | 0.008 | 0.0009 | 0.014 | 0.0039 | 0.0017 |
| P | 0.198 | 0.01 | 1.03 | 0.012 | 0.0009 | 0.042 | 0.0042 | 0.0009 |
| Q | 0.218 | 0.04 | 1.02 | 0.012 | 0.0007 | 0.012 | 0.0035 | 0.0008 |
| R | 0.210 | 0.30 | 0.90 | 0.008 | 0.0007 | 0.012 | 0.0044 | 0.0020 |
| S | 0.205 | 0.45 | 0.90 | 0.009 | 0.0004 | 0.027 | 0.0040 | 0.0012 |
| T | 0.230 | 0.02 | 1.10 | 0.011 | 0.0006 | 0.058 | 0.0038 | 0.0012 |
| U | 0.220 | 0.20 | 1.41 | 0.008 | 0.0020 | 0.042 | 0.0040 | 0.0010 |
| V | 0.216 | 0.20 | 1.41 | 0.007 | 0.0014 | 0.042 | 0.0054 | 0.0010 |
| W | 0.216 | 0.21 | 1.41 | 0.012 | 0.0012 | 0.021 | 0.0060 | 0.0010 |
| X | 0.211 | 0.35 | 1.40 | 0.006 | 0.0014 | 0.021 | 0.0050 | 0.0027 |
| Y | 0.205 | 0.40 | 1.84 | 0.007 | 0.0014 | 0.028 | 0.0040 | 0.0012 |
| Z | 0.120 | 0.40 | 1.70 | 0.007 | 0.0014 | 0.028 | 0.0040 | 0.0014 |
| AA | 0.208 | 0.32 | 1.40 | 0.012 | 0.0012 | 0.054 | 0.0042 | 0.0012 |
| AB | 0.192 | 0.01 | 1.58 | 0.007 | 0.0008 | 0.028 | 0.0040 | 0.0008 |
| AC | 0.190 | 0.01 | 1.50 | 0.007 | 0.0008 | 0.028 | 0.0042 | 0.0008 |

TABLE 1-continued

| | | | | | | | | |
|---|---|---|---|---|---|---|---|---|
| AD | 0.284 | 0.20 | 0.90 | 0.004 | 0.0020 | 0.018 | 0.0034 | 0.0008 |
| AE | 0.350 | 0.48 | 0.90 | 0.004 | 0.0014 | 0.028 | 0.0054 | 0.0006 |
| AF | 0.220 | 0.30 | 0.75 | 0.005 | 0.0010 | 0.030 | 0.0034 | 0.0010 |

| Steel | Chemical composition (mass %) | | | | | | | |
|---|---|---|---|---|---|---|---|---|
| ID | B | Nb | Ti | Cu | Ni | 5[% S] + [% N] | others | Remarks |
| A | 0.0012 | 0.004 | 0.014 | 0.20 | 0.01 | 0.0057 | — | Conforming steel |
| B | 0.0017 | 0.016 | 0.017 | 0.18 | 0.04 | 0.0084 | — | Conforming steel |
| C | tr | tr | tr | tr | tr | 0.0058 | — | Conforming steel |
| D | 0.0005 | tr | 0.052 | tr | tr | 0.0064 | — | Conforming steel |
| E | tr | tr | tr | 0.08 | tr | 0.0028 | — | Conforming steel |
| F | tr | tr | tr | 0.18 | 0.04 | 0.0114 | — | Conforming steel |
| G | 0.0014 | 0.012 | 0.016 | 0.18 | 0.04 | 0.0102 | — | Conforming steel |
| H | 0.0013 | 0.005 | 0.017 | 0.18 | 0.04 | 0.0080 | — | Conforming steel |
| I | 0.0014 | 0.003 | 0.025 | 0.18 | 0.16 | 0.0043 | — | Conforming steel |
| J | 0.0015 | 0.012 | 0.014 | 0.18 | 0.01 | 0.0045 | — | Conforming steel |
| K | 0.0015 | tr | 0.040 | 0.18 | 0.01 | 0.0043 | Mo: 0.05 | Conforming steel |
| L | 0.0015 | 0.030 | 0.006 | 0.30 | 0.14 | 0.0050 | Mo: 0.12, Ce: 0.0005 | Conforming steel |
| M | 0.0013 | 0.025 | 0.005 | 0.20 | 0.10 | 0.0035 | Mo: 0.05, V: 0.05 | Conforming steel |
| N | 0.0013 | 0.035 | tr | 0.22 | 0.40 | 0.0031 | Mo: 0.1, V: 0.05 | Conforming steel |
| O | 0.0002 | 0.002 | 0.017 | 0.14 | 0.01 | 0.0084 | — | Conforming steel |
| P | 0.0012 | tr | 0.020 | tr | tr | 0.0087 | Ca: 0.0012, Cr: 0.18, Mo: 0.05 | Conforming steel |
| Q | 0.0014 | tr | 0.042 | 0.12 | 0.02 | 0.0070 | Sb: 0.006, La: 0.001 | Conforming steel |
| R | 0.0013 | tr | tr | 0.38 | 0.14 | 0.0079 | Zr: 0.02, Sn: 0.003 | Conforming steel |
| S | 0.0008 | 0.005 | tr | 0.21 | 0.08 | 0.0060 | Ca: 0.0003, V: 0.12, W: 0.05 | Conforming steel |
| T | tr | tr | tr | 0.01 | 0.12 | 0.0068 | Ce: 0.001, Zr: 0.02, Mg: 0.001 | Conforming steel |
| U | tr | tr | tr | tr | tr | 0.0140 | — | Comparative steel |
| V | 0.0010 | 0.015 | 0.010 | 0.15 | 0.05 | 0.0124 | — | Comparative steel |
| W | 0.0012 | 0.013 | 0.020 | 0.15 | 0.05 | 0.0120 | — | Comparative steel |
| X | 0.0012 | 0.013 | 0.020 | 0.15 | 0.05 | 0.0120 | — | Comparative steel |
| Y | 0.0012 | 0.009 | 0.015 | 0.18 | 0.01 | 0.0110 | — | Comparative steel |
| Z | 0.0012 | tr | 0.050 | 0.18 | 0.35 | 0.0110 | — | Comparative steel |
| AA | 0.0039 | tr | 0.034 | 0.20 | 0.05 | 0.0102 | — | Comparative steel |
| AB | 0.0010 | 0.102 | 0.010 | 0.18 | 0.01 | 0.0080 | — | Comparative steel |
| AC | 0.0010 | tr | 0.130 | 0.18 | 0.01 | 0.0082 | — | Comparative steel |
| AD | 0.0015 | 0.015 | 0.018 | 0.18 | 0.01 | 0.0134 | — | Comparative steel |
| AE | 0.0013 | 0.032 | 0.005 | 0.22 | 0.10 | 0.0124 | Mo: 0.06, V: 0.05 | Comparative steel |
| AF | 0.0014 | 0.004 | 0.030 | 0.22 | 0.10 | 0.0084 | | Comparative steel |

TABLE 2

| | | Hot rolling conditions | | | | | | Cold rolling conditions | |
|---|---|---|---|---|---|---|---|---|---|
| No. | Steel ID | SRT (° C.) | FT (° C.) | Cooling rate (° C./s) | Holding temp. (° C.) | Holding time (s) | CT (° C.) | Rolling reduction (%) | Sheet thickness (mm) |
| 1 | A | 1210 | 870 | 150 | 700 | 7 | 560 | 72 | 0.5 |
| 2 | B | 1200 | 870 | 150 | 660 | 7 | 570 | 60 | 0.8 |
| 3 | | 1220 | 870 | 150 | 660 | 7 | 570 | 66 | 0.8 |
| 4 | | 1220 | 870 | 200 | 640 | 10 | 570 | 60 | 0.8 |
| 5 | | 1220 | 870 | 150 | 660 | 7 | 570 | 60 | 0.8 |
| 6 | | 1220 | 870 | 150 | 660 | 7 | 570 | 60 | 0.8 |
| 7 | | 1220 | 870 | 30 | 730 | 2 | 570 | 60 | 0.8 |
| 8 | | 1220 | 870 | 40 | 700 | 4 | 490 | 60 | 0.8 |
| 9 | | 1220 | 870 | 50 | 660 | 4 | 570 | 56 | 1.0 |
| 10 | | 1220 | 870 | 70 | 660 | 5 | 570 | 60 | 1.0 |
| 11 | | 1220 | 870 | 70 | 660 | 5 | 570 | 60 | 1.0 |
| 12 | C | 1240 | 880 | 150 | 620 | 8 | 520 | 50 | 1.6 |
| 13 | | 1240 | 880 | 150 | 620 | 8 | 520 | 50 | 1.6 |
| 14 | | 1240 | 880 | 150 | 620 | 8 | 520 | 50 | 1.6 |
| 15 | | 1100 | 880 | 150 | 620 | 8 | 520 | 50 | 1.6 |
| 16 | D | 1220 | 880 | 100 | 620 | 8 | 530 | 54 | 1.2 |
| 17 | | 1220 | 880 | 100 | 620 | 8 | 530 | 54 | 1.2 |
| 18 | | 1220 | 880 | 100 | 620 | 8 | 530 | 54 | 1.2 |
| 19 | | 1220 | 880 | 100 | 620 | 8 | 530 | 54 | 1.2 |
| 20 | | 1220 | 880 | 40 | 730 | 2 | 530 | 54 | 1.2 |
| 21 | E | 1260 | 880 | 170 | 620 | 8 | 500 | 44 | 2.0 |
| 22 | | 1260 | 880 | 170 | 620 | 8 | 500 | 47 | 2.0 |
| 23 | F | 1250 | 910 | 150 | 650 | 7 | 580 | 53 | 1.8 |
| 24 | | 1250 | 910 | 150 | 650 | 7 | 580 | 53 | 1.8 |
| 25 | | 1250 | 910 | 150 | 650 | 7 | 580 | 53 | 1.8 |

TABLE 2-continued

| | | | | | | | | | |
|---|---|---|---|---|---|---|---|---|---|
| 26 | | 1250 | 910 | 150 | 650 | 7 | 580 | 53 | 1.8 |
| 27 | G | 1220 | 900 | 120 | 680 | 7 | 580 | 47 | 1.8 |
| 28 | | 1220 | 900 | 120 | 680 | 7 | 580 | 47 | 1.8 |
| 29 | | 1220 | 900 | 120 | 680 | 7 | 580 | 47 | 1.8 |
| 30 | | 1220 | 900 | 120 | 680 | 7 | 580 | 47 | 1.8 |
| 31 | | 1220 | 900 | 120 | 680 | 7 | 580 | 47 | 1.8 |
| 32 | H | 1220 | 890 | 120 | 680 | 7 | 560 | 53 | 1.8 |
| 33 | | 1220 | 890 | 120 | 680 | 7 | 560 | 53 | 1.8 |
| 34 | | 1220 | 890 | 120 | 680 | 7 | 560 | 53 | 1.8 |
| 35 | I | 1220 | 855 | 100 | 660 | 6 | 620 | 50 | 1.8 |
| 36 | | 1205 | 855 | 100 | 660 | 6 | 590 | 50 | 1.8 |
| 37 | | 1220 | 855 | 100 | 660 | 6 | 590 | 50 | 1.8 |
| 38 | | 1220 | 855 | 100 | 660 | 6 | 590 | 50 | 1.8 |
| 39 | | 1220 | 855 | 100 | 660 | 6 | 590 | 50 | 1.8 |
| 40 | J | 1220 | 850 | 100 | 650 | 7 | 580 | 63 | 1.4 |
| 41 | | 1220 | 850 | 100 | 650 | 7 | 580 | 63 | 1.4 |
| 42 | | 1220 | 850 | 100 | 650 | 7 | 580 | 63 | 1.4 |
| 43 | K | 1220 | 850 | 100 | 650 | 7 | 580 | 63 | 1.4 |
| 44 | L | 1220 | 850 | 100 | 650 | 7 | 580 | 63 | 1.4 |
| 45 | M | 1220 | 850 | 100 | 650 | 7 | 580 | 63 | 1.4 |
| 46 | | 1205 | 850 | 100 | 650 | 7 | 580 | 63 | 1.4 |
| 47 | N | 1220 | 850 | 100 | 650 | 7 | 580 | 63 | 1.4 |
| 48 | O | 1220 | 850 | 100 | 650 | 7 | 580 | 63 | 1.4 |
| 49 | | 1220 | 850 | 100 | 650 | 7 | 580 | 63 | 1.4 |
| 50 | | 1220 | 850 | 100 | 650 | 7 | 580 | 63 | 1.4 |
| 51 | | 1220 | 850 | 100 | 650 | 7 | 580 | 63 | 1.4 |
| 52 | P | 1220 | 860 | 80 | 680 | 7 | 520 | 63 | 1.4 |
| 53 | Q | 1220 | 860 | 80 | 680 | 7 | 520 | 63 | 1.4 |
| 54 | R | 1210 | 860 | 80 | 680 | 7 | 540 | 54 | 1.2 |
| 55 | S | 1210 | 880 | 80 | 700 | 6 | 550 | 54 | 1.2 |
| 56 | | 1210 | 880 | 45 | 720 | 2 | 550 | 54 | 1.2 |
| 57 | T | 1220 | 880 | 80 | 700 | 6 | 550 | 54 | 1.2 |
| 58 | U | 1210 | 870 | 120 | 680 | 6 | 520 | 54 | 1.2 |
| 59 | | 1210 | 870 | 120 | 680 | 6 | 520 | 54 | 1.2 |
| 60 | | 1210 | 870 | 120 | 680 | 6 | 520 | 54 | 1.2 |
| 61 | | 1210 | 870 | 120 | 680 | 6 | 520 | 54 | 1.2 |
| 62 | | 1210 | 870 | 120 | 680 | 6 | 520 | 54 | 1.2 |
| 63 | | 1210 | 870 | 120 | 680 | 6 | 520 | 54 | 1.2 |
| 64 | | 1210 | 870 | 30 | 710 | 3 | 520 | 54 | 1.2 |
| 65 | V | 1215 | 880 | 150 | 670 | 6 | 550 | 53 | 1.8 |
| 66 | | 1215 | 880 | 30 | 710 | 3 | 550 | 53 | 1.8 |
| 67 | W | 1220 | 890 | 150 | 670 | 6 | 560 | 53 | 1.8 |
| 68 | X | 1210 | 890 | 150 | 670 | 6 | 560 | 53 | 1.8 |
| 69 | Y | 1210 | 890 | 30 | 690 | 3 | 560 | 53 | 1.8 |
| 70 | Z | 1220 | 880 | 150 | 670 | 6 | 550 | 53 | 1.8 |
| 71 | AA | 1220 | 880 | 150 | 670 | 6 | 580 | 53 | 1.8 |
| 72 | AB | 1220 | 880 | 150 | 670 | 6 | 580 | 53 | 1.8 |
| 73 | AC | 1220 | 880 | 150 | 670 | 6 | 580 | 54 | 1.2 |
| 74 | AD | 1220 | 890 | 150 | 670 | 6 | 560 | 54 | 1.2 |
| 75 | AE | 1220 | 890 | 170 | 650 | 8 | 560 | 54 | 1.2 |
| 76 | AF | 1220 | 900 | 180 | 660 | 7 | 550 | 54 | 1.2 |

| | Annealing conditions | | | | | | | |
|---|---|---|---|---|---|---|---|---|
| No. | AT (° C.) | Soaking time (s) | Cooling start temp. (° C.) | Cooling rate (° C./s) | Cooling stop temp. (° C.) | Holding temp. (° C.) | Holding time (sec) | Remarks |
| 1 | 890 | 420 | 800 | 2000 | R.T. | 180 | 880 | Example |
| 2 | 890 | 420 | 800 | 1800 | R.T. | 150 | 880 | Comparative Example |
| 3 | 890 | 420 | 800 | 1800 | R.T. | 150 | 880 | Example |
| 4 | 890 | 420 | 800 | 1800 | R.T. | 150 | 880 | Example |
| 5 | 890 | 180 | 770 | 1800 | R.T. | 160 | 240 | Comparative Example |
| 6 | 850 | 400 | 770 | 1800 | R.T. | 160 | 860 | Comparative Example |
| 7 | 890 | 400 | 800 | 1800 | R.T. | 150 | 860 | Example |
| 8 | 890 | 400 | 800 | 1800 | R.T. | 150 | 860 | Example |
| 9 | 890 | 400 | 800 | 1500 | R.T. | 150 | 860 | Example |
| 10 | 890 | 400 | 675 | 1500 | R.T. | 150 | 860 | Comparative Example |
| 11 | 890 | 400 | 800 | 1500 | R.T. | 20 | 860 | Comparative Example |
| 12 | 900 | 540 | 800 | 1000 | R.T. | 165 | 1000 | Example |
| 13 | 900 | 360 | 800 | 1000 | R.T. | 155 | 500 | Example |
| 14 | 910 | 960 | 800 | 1000 | R.T. | 150 | 1500 | Comparative Example |
| 15 | 880 | 120 | 800 | 1000 | R.T. | 165 | 240 | Comparative Example |
| 16 | 868 | 330 | 820 | 1200 | R.T. | 240 | 400 | Example |
| 17 | 868 | 330 | 820 | 1200 | R.T. | 200 | 400 | Example |
| 18 | 900 | 350 | 820 | 1200 | R.T. | 200 | 800 | Example |
| 19 | 900 | 350 | 820 | 1200 | R.T. | 185 | 800 | Example |
| 20 | 900 | 390 | 820 | 1200 | R.T. | 200 | 800 | Example |
| 21 | 865 | 540 | 800 | 600 | R.T. | 210 | 520 | Example |
| 22 | 900 | 400 | 800 | 600 | R.T. | 150 | 480 | Example |

TABLE 2-continued

| | | | | | | | | |
|---|---|---|---|---|---|---|---|---|
| 23 | 900 | 390 | 800 | 800 | R.T. | 190 | 800 | Example |
| 24 | 900 | 460 | 800 | 800 | R.T. | 170 | 800 | Example |
| 25 | 900 | 460 | 800 | 800 | R.T. | 150 | 800 | Example |
| 26 | 900 | 430 | 800 | 800 | R.T. | 150 | 400 | Example |
| 27 | 880 | 500 | 770 | 800 | R.T. | 190 | 840 | Example |
| 28 | 900 | 420 | 770 | 800 | R.T. | 175 | 800 | Example |
| 29 | 900 | 420 | 770 | 800 | R.T. | 160 | 800 | Example |
| 30 | 900 | 400 | 770 | 800 | R.T. | 150 | 600 | Example |
| 31 | 900 | 420 | 770 | 800 | R.T. | 270 | 800 | Comparative Example |
| 32 | 890 | 450 | 785 | 800 | R.T. | 175 | 800 | Example |
| 33 | 890 | 450 | 785 | 800 | R.T. | 160 | 800 | Example |
| 34 | 890 | 330 | 785 | 800 | R.T. | 155 | 600 | Example |
| 35 | 905 | 400 | 790 | 800 | R.T. | 220 | 520 | Example |
| 36 | 905 | 400 | 790 | 800 | R.T. | 220 | 520 | Example |
| 37 | 905 | 400 | 790 | 800 | R.T. | 160 | 520 | Example |
| 38 | 905 | 400 | 710 | 800 | R.T. | 205 | 520 | Example |
| 39 | 905 | 305 | 790 | 800 | R.T. | 295 | 300 | Comparative Example |
| 40 | 905 | 400 | 800 | 1200 | R.T. | 175 | 520 | Example |
| 41 | 885 | 120 | 800 | 1200 | R.T. | 185 | 360 | Comparative Example |
| 42 | 885 | 340 | 800 | 1200 | R.T. | 480 | 60 | Comparative Example |
| 43 | 905 | 400 | 800 | 1200 | R.T. | 165 | 520 | Example |
| 44 | 905 | 400 | 800 | 1200 | R.T. | 160 | 520 | Example |
| 45 | 905 | 400 | 800 | 1200 | R.T. | 190 | 520 | Example |
| 46 | 895 | 120 | 800 | 1200 | R.T. | 195 | 520 | Comparative Example |
| 47 | 900 | 420 | 800 | 1200 | R.T. | 180 | 540 | Example |
| 48 | 910 | 400 | 800 | 1200 | R.T. | 190 | 520 | Example |
| 49 | 910 | 400 | 800 | 1200 | R.T. | 175 | 520 | Example |
| 50 | 900 | 380 | 800 | 100 | 200 | 150 | 120 | Example |
| 51 | 890 | 360 | 800 | 40 | 170 | 150 | 60 | Comparative Example |
| 52 | 900 | 350 | 800 | 1200 | R.T. | 150 | 360 | Example |
| 53 | 900 | 340 | 800 | 1200 | R.T. | 210 | 420 | Example |
| 54 | 900 | 400 | 760 | 1200 | R.T. | 170 | 700 | Example |
| 55 | 868 | 310 | 760 | 1200 | R.T. | 180 | 700 | Example |
| 56 | 868 | 310 | 760 | 1200 | R.T. | 175 | 700 | Example |
| 57 | 885 | 420 | 770 | 1200 | R.T. | 210 | 700 | Example |
| 58 | 890 | 400 | 770 | 1200 | R.T. | 200 | 700 | Comparative Example |
| 59 | 890 | 400 | 770 | 1200 | R.T. | 180 | 700 | Comparative Example |
| 60 | 890 | 400 | 770 | 1200 | R.T. | 165 | 700 | Comparative Example |
| 61 | 890 | 400 | 770 | 1200 | R.T. | 150 | 700 | Comparative Example |
| 62 | 850 | 310 | 740 | 1200 | R.T. | 210 | 700 | Comparative Example |
| 63 | 850 | 310 | 740 | 1200 | R.T. | 175 | 700 | Comparative Example |
| 64 | 850 | 280 | 740 | 1200 | R.T. | 210 | 700 | Comparative Example |
| 65 | 880 | 305 | 780 | 800 | R.T. | 205 | 800 | Comparative Example |
| 66 | 880 | 120 | 780 | 800 | R.T. | 200 | 800 | Comparative Example |
| 67 | 880 | 320 | 750 | 800 | R.T. | 205 | 800 | Comparative Example |
| 68 | 880 | 320 | 750 | 800 | R.T. | 200 | 800 | Comparative Example |
| 69 | 890 | 380 | 750 | 800 | R.T. | 190 | 800 | Comparative Example |
| 70 | 910 | 360 | 820 | 800 | R.T. | 150 | 800 | Comparative Example |
| 71 | 890 | 320 | 780 | 800 | R.T. | 190 | 800 | Comparative Example |
| 72 | 890 | 320 | 800 | 800 | R.T. | 190 | 740 | Comparative Example |
| 73 | 890 | 340 | 780 | 1200 | R.T. | 200 | 800 | Comparative Example |
| 74 | 890 | 380 | 780 | 1200 | R.T. | 180 | 800 | Comparative Example |
| 75 | 900 | 400 | 800 | 1200 | R.T. | 180 | 800 | Comparative Example |
| 76 | 890 | 400 | 780 | 1200 | R.T. | 210 | 800 | Comparative Example |

For each steel sheet thus obtained, analysis and measurement was performed to identify the steel microstructure in accordance with the above-described method.

We also conducted: 1) tensile test, 2) evaluation of delayed fracture resistance, 3) evaluation of the stability of delayed fracture resistance, and 4) measurement of change in thickness of each steel sheet (coil) in the rolling direction.

The results are presented in Table 3.

1) Tensile Test

In tensile test, tensile test was performed according to JIS Z 2241 on JIS No. 5 tensile test pieces, each being cut out at a position of one-fourth the width of the coil in the width direction with its longitudinal direction parallel to a direction orthogonal to the rolling direction, and their yield strength (YP), tensile strength (TS), and elongation (El) were evaluated.

2) Evaluation of Delayed Fracture Resistance

Delayed fracture resistance was evaluated as explained below. Specifically, for each of the obtained steel sheets (coils), a test piece strip of 100 mm long in the direction orthogonal to the rolling direction and 30 mm wide in the rolling direction was collected from a position of one-fourth the width of the coil in the width direction. Each test piece was cut by shearing to have an end face on the long side with a length of 100 mm, and was subjected as sheared (without machining to remove burrs) to bending so that a burr emerged on the bending outer periphery side, and was fixed with bolts while maintaining the shape as assumed by the test piece at the time of bending. In shearing, the clearance was set to 13% and the rake angle to 20. Bending was performed with a bending radius satisfying the relation of R/t=3.0 where R denotes the tip bending radius and t denotes the thickness of the steel sheet (for a sheet thickness of 2.0 mm, for example, bending is performed with a punch having a tip bending radius of 6.0 mm), so that the inner apex angle of the bend was 90° (V bending). As for the punch, one with a tip radius equal to the above-described tip bending radius R and having a U-shape was used (the tip has a semicircular round portion and the punch body portion had a thickness equal to 2R). As for the die, one with a die shoulder R of 30 mm was used. Then, the depth to which the punch pushes the steel sheet was adjusted, and forming was performed so that the tip bending angle (the inner apex angle of the bend) was 90° (V shape). Each test piece was clamped with a hydraulic jack and fixed with bolts in this state so as to have a shape identical to that at the press bottom dead center (so that any opening formed by spring back in a straight portion is canceled out). Each bolt was fixed by passing it through a hole of elliptical shape (short axis 10 mm, long axis 15 mm) provided in advance 10 mm inside from the short side edge of the test piece strip. Each test piece thus obtained after bolting was immersed in at least 1 L of hydrochloric acid (an aqueous hydrogen chloride solution) having a pH of 1, and was subjected to test for evaluating delayed fracture resistance under the condition of aqueous solution temperature of 20° C. while keeping the pH constant. Each test piece was then checked for microcracks (origins of delayed fracture) at a visually observable level (about 1 mm long) by visual observation or by camera, and measurement was made of the time from the start of immersion of the test piece until the initiation of microcracking as the delayed fracture time. However, when no microcracks were observed even after 200 hours had elapsed from the start of immersion of the test piece, it was judged as "no fracture".

In this case, it was judged as "no fracture" when the TS was 1,320 MPa or more and less than 1,530 MPa, and the delayed fracture resistance was determined to be excellent when the time to delayed fracture was 24 hours or longer for TS of 1,530 MPa or more and less than 1,550 MPa, 12 hours or longer for TS of 1,550 MPa or more and less than 1,570 MPa, 9 hours or longer for TS of 1,570 MPa or more and less than 1,610 MPa, 1.0 hours or longer for TS of 1,610 MPa or more and less than 1,960 MPa, or 0.2 hours or longer for TS of 1,960 MPa or more.

3) Evaluation of the Stability of Delayed Fracture Resistance

The stability of delayed fracture resistance was evaluated as explained below. In each instance, a coil having a width of 760 mm was divided into halves of 380 mm wide with a slit, sheared continuously to a length of 1,350 mm in the longitudinal direction of the coil to form a blank material, and three blank sheets were collected from the blank material for each portion of the coil top portion, the coil middle portion, and the coil end portion. The blank sheets were then subjected to cold press forming into a side sill R/F part shape (forming mainly involving 90° bending) to obtain nine press formed parts. Each of the press formed parts thus obtained was immersed in 150 L of hydrochloric acid having a pH of 1, and checked for microcracks (origins of delayed fracture) at a visually observable level (about 1 mm long) by visual observation or by camera, and measurement was made of the time from the start of immersion of the test piece until the initiation of microcracking. The stability of delayed fracture resistance was evaluated on the basis of the initiation time of microcracking for the one in which microcracking occurred earliest among the nine press formed parts.

The stability of delayed fracture resistance was evaluated according to the same criteria as those described above for evaluation of the delayed fracture resistance of each steel sheet.

4) Investigation of the Amount of Sheet Thickness Variation in the Rolling Direction of Each Steel Sheet (Coil)

Measurement was made of the sheet thickness of each steel sheet over its entire length with an X-ray thickness gauge, and the amount of sheet thickness variation as measured over the entire length was used as the amount of sheet thickness variation in the rolling direction Δt of the coil.

TABLE 3

| | | | Microstructure | | | | | |
|---|---|---|---|---|---|---|---|---|
| No. | Steel ID | Sheet thickness (mm) | Area ratio of TM + B* (%) | Area ratio of remainder* (%) | Number of inclusion groups (/mm$^2$) | Number of carbides A (/mm$^2$) | Number of carbides B (×10$^7$/mm$^2$) | Mean grain size of prior γ grains (μm) |
| 1 | A | 0.5 | 100 | 0 | 0.2 | 1900 | 2.2 | 10 |
| 2 | B | 0.8 | 100 | 0 | 0.9 | 1800 | 4.7 | 8 |
| 3 | | 0.8 | 100 | 0 | 0.6 | 1600 | 4.7 | 8 |
| 4 | | 0.8 | 100 | 0 | 0.6 | 1600 | 4.7 | 8 |
| 5 | | 0.8 | 100 | 0 | 0.6 | 4500 | 4.0 | 6 |
| 6 | | 0.8 | 100 | 0 | 0.6 | 8500 | 4.0 | 4 |
| 7 | | 0.8 | 100 | 0 | 0.6 | 1600 | 4.9 | 8 |
| 8 | | 0.8 | 100 | 0 | 0.6 | 1200 | 4.9 | 8 |
| 9 | | 1.0 | 100 | 0 | 0.6 | 1800 | 4.7 | 8 |
| 10 | | 1.0 | 90 | F:10 | 0.6 | 1800 | 4.2 | 4 |
| 11 | | 1.0 | 100 | 0 | 0.6 | 1600 | 0 | 8 |
| 12 | C | 1.6 | 100 | 0 | 0 | 0 | 3.1 | 15 |
| 13 | | 1.6 | 100 | 0 | 0 | 600 | 4.8 | 10 |
| 14 | | 1.6 | 100 | 0 | 0 | 0 | 3.6 | 19 |
| 15 | | 1.6 | 100 | 0 | 0.9 | 6400 | 4.0 | 6 |
| 16 | D | 1.2 | 100 | 0 | 0.2 | 3500 | 0.7 | 4 |
| 17 | | 1.2 | 100 | 0 | 0.2 | 3500 | 3.6 | 4 |
| 18 | | 1.2 | 100 | 0 | 0.2 | 1800 | 3.1 | 5 |
| 19 | | 1.2 | 100 | 0 | 0.2 | 1800 | 3.1 | 5 |
| 20 | | 1.2 | 100 | 0 | 0.2 | 400 | 3.1 | 5 |
| 21 | E | 2.0 | 100 | 0 | 0 | 3500 | 2.4 | 8 |
| 22 | | 2.0 | 100 | 0 | 0 | 200 | 2.4 | 10 |
| 23 | F | 1.8 | 100 | 0 | 0.8 | 200 | 1.9 | 8 |
| 24 | | 1.8 | 100 | 0 | 0.8 | 0 | 2.2 | 8 |
| 25 | | 1.8 | 100 | 0 | 0.8 | 0 | 3.8 | 8 |
| 26 | | 1.8 | 100 | 0 | 0.8 | 0 | 4.4 | 8 |
| 27 | G | 1.8 | 100 | 0 | 0.6 | 1600 | 1.8 | 8 |

TABLE 3-continued

| | | | | | | | | |
|---|---|---|---|---|---|---|---|---|
| 28 | | 1.8 | 100 | 0 | 0.6 | 400 | 2.0 | 8 |
| 29 | | 1.8 | 100 | 0 | 0.6 | 200 | 3.4 | 8 |
| 30 | | 1.8 | 100 | 0 | 0.6 | 200 | 4.6 | 8 |
| 31 | | 1.8 | 100 | 0 | 0.6 | 3000 | 0.6 | 8 |
| 32 | H | 1.8 | 100 | 0 | 0.3 | 400 | 1.8 | 8 |
| 33 | | 1.8 | 100 | 0 | 0.3 | 600 | 2.0 | 8 |
| 34 | | 1.8 | 100 | 0 | 0.3 | 2100 | 4.1 | 7 |
| 35 | I | 1.8 | 100 | 0 | 0 | 0 | 0.8 | 8 |
| 36 | | 1.8 | 100 | 0 | 0 | 0 | 0.8 | 8 |
| 37 | | 1.8 | 100 | 0 | 0 | 0 | 4.8 | 8 |
| 38 | | 1.8 | 95 | 5 | 0 | 0 | 1.6 | 8 |
| 39 | | 1.8 | 100 | 0 | 0 | 4600 | 0.5 | 8 |
| 40 | J | 1.4 | 100 | 0 | 0 | 0 | 3.2 | 6 |
| 41 | | 1.4 | 100 | 0 | 0 | 6200 | 2.1 | 5 |
| 42 | | 1.4 | 100 | 0 | 0 | 7800 | 0.3 | 4 |
| 43 | K | 1.4 | 100 | 0 | 0 | 800 | 4.8 | 6 |
| 44 | L | 1.4 | 100 | 0 | 0 | 0 | 4.8 | 6 |
| 45 | M | 1.4 | 100 | 0 | 0 | 0 | 5.6 | 6 |
| 46 | | 1.4 | 100 | 0 | 0.1 | 5700 | 6.5 | 6 |
| 47 | N | 1.4 | 100 | 0 | 0 | 0 | 5.2 | 6 |
| 48 | O | 1.4 | 100 | 0 | 0.7 | 400 | 1.6 | 6 |
| 49 | | 1.4 | 100 | 0 | 0.7 | 200 | 3.2 | 6 |
| 50 | | 1.4 | 100 | 0 | 0.7 | 600 | 0.9 | 6 |
| 51 | | 1.4 | 100 | 0 | 0.7 | 4300 | 0.3 | 5 |
| 52 | P | 1.4 | 100 | 0 | 0 | 1700 | 4.2 | 8 |
| 53 | Q | 1.4 | 100 | 0 | 0.4 | 1500 | 1.2 | 8 |
| 54 | R | 1.2 | 100 | 0 | 0.5 | 900 | 3.6 | 8 |
| 55 | S | 1.2 | 100 | 0 | 0 | 3000 | 2.4 | 8 |
| 56 | | 1.2 | 100 | 0 | 0 | 3200 | 2.8 | 8 |
| 57 | T | 1.2 | 100 | 0 | 0.2 | 1900 | 0.9 | 8 |
| 58 | U | 1.2 | 100 | 0 | 1.4 | 1900 | 2.6 | 8 |
| 59 | | 1.2 | 100 | 0 | 1.4 | 1800 | 3.4 | 8 |
| 60 | | 1.2 | 100 | 0 | 1.4 | 1800 | 4.1 | 8 |
| 61 | | 1.2 | 100 | 0 | 1.4 | 1800 | 4.8 | 8 |
| 62 | | 1.2 | 100 | 0 | 1.4 | 9500 | 1.0 | 8 |
| 63 | | 1.2 | 100 | 0 | 1.4 | 9200 | 1.4 | 8 |
| 64 | | 1.2 | 100 | 0 | 1.4 | 9500 | 0.8 | 8 |
| 65 | V | 1.8 | 100 | 0 | 1.0 | 3400 | 3.0 | 8 |
| 66 | | 1.8 | 100 | 0 | 1.0 | 6100 | 2.9 | 8 |
| 67 | W | 1.8 | 100 | 0 | 1.0 | 3200 | 2.9 | 8 |
| 68 | X | 1.8 | 100 | 0 | 0.9 | 3000 | 2.8 | 8 |
| 69 | Y | 1.8 | 100 | 0 | 1.2 | 2800 | 3.4 | 8 |
| 70 | Z | 1.8 | 100 | 0 | 0.8 | 1400 | 2.4 | 6 |
| 71 | AA | 1.8 | 100 | 0 | 0.7 | 6200 | 3.6 | 6 |
| 72 | AB | 1.8 | 100 | 0 | 1.0 | 1200 | 2.0 | 3 |
| 73 | AC | 1.2 | 100 | 0 | 0.9 | 2000 | 2.0 | 3 |
| 74 | AD | 1.2 | 100 | 0 | 1.3 | 2100 | 4.7 | 8 |
| 75 | AE | 1.2 | 100 | 0 | 0.9 | 2200 | 5.8 | 8 |
| 76 | AF | 1.2 | 100 | 0 | 0.5 | 2100 | 2.2 | 8 |

| | Mechanical properties | | | Delayed fracture resistance | Stability of delayed fracture resistance | Amount of sheet thickness variation | |
|---|---|---|---|---|---|---|---|
| No. | YP (MPa) | TS (MPa) | El (%) | Time to delayed fracture (hr) | Time to delayed fracture (hr) | Δt (μm) | Remarks |
| 1 | 1154 | 1324 | 8 | no fracture | no fracture | 42 | Example |
| 2 | 1234 | 1507 | 8 | 54 | 58 | 92 | Comparative Example |
| 3 | 1234 | 1512 | 8 | no fracture | no fracture | 124 | Example |
| 4 | 1234 | 1512 | 8 | no fracture | no fracture | 54 | Example |
| 5 | 1240 | 1525 | 8 | 28 | 31 | 128 | Comparative Example |
| 6 | 1250 | 1526 | 8 | 9 | 10 | 120 | Comparative Example |
| 7 | 1244 | 1510 | 8 | no fracture | 64 | 400 | Example |
| 8 | 1244 | 1510 | 8 | no fracture | 80 | 355 | Example |
| 9 | 1228 | 1508 | 8 | no fracture | no fracture | 240 | Example |
| 10 | 1080 | 1435 | 6 | 18 | 18 | 180 | Comparative Example |
| 11 | 1220 | 1528 | 9 | 64 | 64 | 184 | Comparative Example |
| 12 | 1235 | 1530 | 8 | no fracture | no fracture | 68 | Example |
| 13 | 1305 | 1582 | 8 | no fracture | no fracture | 74 | Example |
| 14 | 1520 | 1526 | 8 | 22 | 24 | 66 | Comparative Example |
| 15 | 1240 | 1526 | 8 | 20 | — | 72 | Comparative Example |
| 16 | 1340 | 1478 | 8 | no fracture | — | 164 | Example |
| 17 | 1300 | 1536 | 8 | 32 | — | 164 | Example |
| 18 | 1235 | 1524 | 8 | no fracture | no fracture | 152 | Example |
| 19 | 1235 | 1549 | 8 | no fracture | no fracture | 152 | Example |
| 20 | 1235 | 1524 | 8 | no fracture | 18 | 380 | Example |
| 21 | 1280 | 1520 | 8 | no fracture | — | 48 | Example |
| 22 | 1268 | 1580 | 8 | no fracture | no fracture | 52 | Example |

TABLE 3-continued

| | | | | | | | |
|---|---|---|---|---|---|---|---|
| 23 | 1290 | 1511 | 8 | no fracture | — | 90 | Example |
| 24 | 1285 | 1539 | 8 | 24 | — | 88 | Example |
| 25 | 1275 | 1559 | 8 | 15 | — | 88 | Example |
| 26 | 1270 | 1570 | 8 | 9 | — | 90 | Example |
| 27 | 1300 | 1510 | 8 | no fracture | — | 96 | Example |
| 28 | 1290 | 1538 | 8 | no fracture | no fracture | 88 | Example |
| 29 | 1280 | 1552 | 8 | 24 | 24 | 84 | Example |
| 30 | 1270 | 1573 | 8 | 12 | 14 | 84 | Example |
| 31 | 1340 | 1410 | 8 | 9 | 11 | 90 | Comparative Example |
| 32 | 1299 | 1537 | 8 | no fracture | — | 102 | Example |
| 33 | 1290 | 1558 | 8 | no fracture | no fracture | 98 | Example |
| 34 | 1280 | 1575 | 8 | 24 | 24 | 98 | Example |
| 35 | 1360 | 1515 | 8 | no fracture | no fracture | 44 | Example |
| 36 | 1340 | 1505 | 8 | no fracture | no fracture | 62 | Example |
| 37 | 1320 | 1603 | 8 | no fracture | no fracture | 64 | Example |
| 38 | 1250 | 1500 | 8 | no fracture | no fracture | 68 | Example |
| 39 | 1370 | 1450 | 8 | 4 | — | 68 | Comparative Example |
| 40 | 1530 | 1788 | 7 | 2 | — | 80 | Example |
| 41 | 1545 | 1790 | 7 | 0.6 | — | 80 | Comparative Example |
| 42 | 1380 | 1429 | 8 | 6 | — | 80 | Comparative Example |
| 43 | 1518 | 1780 | 7 | 3 | — | 134 | Example |
| 44 | 1500 | 1770 | 7 | 3 | — | 102 | Example |
| 45 | 1760 | 2001 | 6 | 0.3 | — | 88 | Example |
| 46 | 1765 | 2010 | 6 | 0.07 | — | 75 | Comparative Example |
| 47 | 1740 | 1988 | 6 | 0.4 | — | 120 | Example |
| 48 | 1300 | 1502 | 8 | no fracture | no fracture | 134 | Example |
| 49 | 1280 | 1533 | 8 | 48 | — | 144 | Example |
| 50 | 1310 | 1410 | 9 | no fracture | — | 144 | Example |
| 51 | 1310 | 1350 | 9 | 62 | — | 144 | Comparative Example |
| 52 | 1200 | 1498 | 8 | no fracture | no fracture | 98 | Example |
| 53 | 1330 | 1502 | 8 | no fracture | — | 102 | Example |
| 54 | 1280 | 1510 | 8 | no fracture | — | 110 | Example |
| 55 | 1255 | 1518 | 8 | no fracture | no fracture | 96 | Example |
| 56 | 1265 | 1522 | 8 | no fracture | 48 | 400 | Example |
| 57 | 1340 | 1520 | 8 | no fracture | — | 114 | Example |
| 58 | 1315 | 1514 | 8 | 24 | 25 | 90 | Comparative Example |
| 59 | 1302 | 1539 | 8 | 14 | 16 | 91 | Comparative Example |
| 60 | 1290 | 1557 | 8 | 9 | 10 | 90 | Comparative Example |
| 61 | 1280 | 1579 | 8 | 7 | 8 | 92 | Comparative Example |
| 62 | 1292 | 1518 | 8 | 8 | 8 | 94 | Comparative Example |
| 63 | 1288 | 1538 | 8 | 4 | 4 | 94 | Comparative Example |
| 64 | 1299 | 1518 | 8 | 8 | 2 | 370 | Comparative Example |
| 65 | 1290 | 1514 | 8 | 38 | 41 | 120 | Comparative Example |
| 66 | 1292 | 1516 | 8 | 12 | 3 | 370 | Comparative Example |
| 67 | 1290 | 1514 | 8 | 48 | 50 | 130 | Comparative Example |
| 68 | 1305 | 1518 | 8 | 68 | 74 | 120 | Comparative Example |
| 69 | 1298 | 1512 | 8 | 33 | 8 | 450 | Comparative Example |
| 70 | 1044 | 1260 | 9 | no fracture | — | — | Comparative Example |
| 71 | 1310 | 1526 | 9 | 23 | — | — | Comparative Example |
| 72 | 1335 | 1527 | 6 | 45 | — | — | Comparative Example |
| 73 | 1340 | 1523 | 6 | 52 | — | — | Comparative Example |
| 74 | 1537 | 1778 | 6 | 0.1 | — | — | Comparative Example |
| 75 | 1790 | 1998 | 5 | 0.0 | — | — | Comparative Example |
| 76 | 1320 | 1524 | 7 | 65.0 | — | — | Comparative Example |

*TM: tempered martensite, B: bainite, F: ferrite

It can be seen from Table 3 that our examples all provided cold-rolled steel sheets having high-strength with tensile strength (TS) of 1,320 MPa or more and excellent delayed fracture resistance.

Among our examples, those with the amount of sheet thickness variation in the rolling direction reduced to 300 μm or less also exhibited excellent stability of delayed fracture resistance.

In contrast, comparative examples did not exhibit sufficient strength or satisfactory delayed fracture resistance.

The invention claimed is:

1. A cold-rolled steel sheet comprising:

a chemical composition that contains, in mass %, C: 0.15% or more and 0.40% or less, Si: 1.5% or less, Mn: 0.9% to 1.7%, P: 0.03% or less, S: less than 0.0020%, sol.Al: 0.2% or less, N: less than 0.0055%, O: 0.0025% or less, and the balance consisting of Fe and incidental impurities, and that satisfies a relation expressed by:

$$5[\%\ S]+[\%\ N]<0.0115 \quad (1),$$

where [% S] and [% N] denote contents in mass % of S and N in steel, respectively;

a microstructure in which tempered martensite and bainite are contained in a total area ratio of 95% or more and 100% or less with respect to a whole volume of the microstructure, a number of inclusion groups having a total length in a rolling direction of more than 120 μm is at most $0.8/mm^2$, the inclusion groups being formed by one or more inclusion particles, the one or more inclusion particles having a major axis length of 0.3 μm or more and extending and/or distributed in a dot-sequence manner along the rolling direction, and in the case of an inclusion group being formed by two or more inclusion particles, the two or more inclusion particles are spaced apart from one another by 30 μm or less, a number of carbides mainly composed of Fe that have an aspect ratio of 2.5 or less and a major axis length of 0.20 μm or more and 2 μm or less is at most 3,500/$mm_2$, a number of carbides that are distributed in the tempered martensite and/or in the bainite and that have a diameter of 10 nm to 50 nm is at least $0.7\times10^7/mm^2$, and prior γ grains have a mean grain size of 18 μm or less;

a sheet thickness of 0.5 mm to 2.6 mm; and a tensile strength of 1,320 MPa or more, wherein an amount of sheet thickness variation in the rolling direction is 300 μm or less.

2. The cold-rolled steel sheet of claim 1, wherein Mn content of the chemical composition is 0.9% to 1.4%.

3. The cold-rolled steel sheet of claim 1, wherein the chemical composition consists of, in mass %, C: 0.15% or more and 0.40% or less, Si: 1.5% or less, Mn: 0.9% to 1.4%, P: 0.03% or less, S: less than 0.0020%, sol.Al: 0.2% or less, N: less than 0.0055%, O: 0.0025% or less, and the balance consisting of Fe and incidental impurities, and that satisfies a relation expressed by:

$$5[\%\ S]+[\%\ N]<0.0115 \quad (1),$$

where [% S] and [% N] denote contents in mass % of S and N in steel, respectively.

4. A method for manufacturing the cold-rolled steel sheet of claim 1, comprising:

hot rolling a steel slab having the chemical composition as recited in claim 1 with a slab reheating temperature of higher than 1,200° C. to obtain a hot-rolled steel sheet;

then cold rolling the hot-rolled steel sheet with a rolling reduction of 20% to 75% to obtain a cold-rolled steel sheet having a sheet thickness of 0.5 mm to 2.6 mm;

then subjecting the cold-rolled steel sheet to continuous annealing, in which the cold-rolled steel sheet is:

subjected to soaking with an annealing temperature of higher than 850° C. and no higher than 910° C. for a duration of more than 300 seconds and no more than 900 seconds;

then cooled from 680° C. or higher to 260° C. or lower at a mean cooling rate of 70° C./s or higher;

then optionally reheated; and then retained in a temperature range of 150° C. to 260° C. for 20 seconds to 1,500 seconds, wherein the hot rolling comprises:

finish rolling the steel slab with a finisher delivery temperature of 840° C. to 950° C.;

then cooling the hot-rolled steel sheet to 700° C. or lower at a cooling rate of 40° C./s or higher;

then retaining the hot-rolled steel sheet at a temperature range of 600° C. to 700° C. for 4 seconds or more;

then cooling the hot-rolled steel sheet to a temperature range of 500° C. to 630° C.; and then coiling the hot-rolled steel sheet.

5. A cold-rolled steel sheet comprising:

a chemical composition that contains, in mass %, C: 0.15% or more and 0.40% or less, Si: 1.5% or less, Mn: 0.9% to 1.7%, P: 0.03% or less, S: less than 0.0020%, sol.Al: 0.2% or less, N: less than 0.0055%, O: 0.0025% or less, at least one selected from the following groups (a) to (f):

(a) B: 0.0002% or more and less than 0.0035%;

(b) either or both of Nb: 0.002% to 0.08% and Ti: 0.002% to 0.12%;

(c) either or both of Cu: 0.005% to 1% and Ni: 0.01% to 1%;

(d) one or more selected from the group consisting of Cr: 0.01% to 1.0%, Mo: 0.01% or more and less than 0.3%, V: 0.003% to 0.5%, Zr: 0.005% to 0.2%, and W: 0.005% to 0.2%;

(e) one or more selected from the group consisting of Ca: 0.0002% to 0.0030%, Ce: 0.0002% to 0.0030%, La: 0.0002% to 0.0030%, and Mg: 0.0002% to 0.0030%; and (f) either or both of Sb: 0.002% to 0.1% and Sn: 0.002% to 0.1%; and the balance consisting of Fe and incidental impurities, and that satisfies a relation expressed by:

$$5[\%\ S]+[\%\ N]<0.0115 \quad (1),$$

where [% S] and [% N] denote contents in mass % of S and N in steel, respectively;

a microstructure in which tempered martensite and bainite are contained in a total area ratio of 95% or more and 100% or less with respect to a whole volume of the microstructure, a number of inclusion groups having a total length in a rolling direction of more than 120 μm is at most $0.8/mm^2$, the inclusion groups being formed by one or more inclusion particles, the one or more inclusion particles having a major axis length of 0.3 μm or more and extending and/or distributed in a dot-sequence manner along the rolling direction, and in the case of an inclusion group being formed by two or more inclusion particles, the two or more inclusion particles are spaced apart from one another by 30 μm or less, a number of carbides mainly composed of Fe that have an aspect ratio of 2.5 or less and a major axis length of 0.20 μm or more and 2 μm or less is at most $3,500/mm^2$, a number of carbides that are distributed in the tempered martensite and/or in the bainite and that have a diameter of 10 nm to 50 nm is at least $0.7\times10^7/mm^2$, and prior γ grains have a mean grain size of 18 μm or less;

a sheet thickness of 0.5 mm to 2.6 mm; and a tensile strength of 1,320 MPa or more, wherein an amount of sheet thickness variation in the rolling direction is 300 μm or less.

6. The cold-rolled steel sheet of claim 5, wherein Mn content of the chemical composition is 0.9% to 1.4%.

7. The cold-rolled steel sheet of claim 5, wherein the chemical composition consists of, in mass %, C: 0.15% or more and 0.40% or less, Si: 1.5% or less, Mn: 0.9% to 1.4%, P: 0.03% or less, S: less than 0.0020%, sol.Al: 0.2% or less, N: less than 0.0055%, O: 0.0025% or less, at least one selected from the following groups (b) to (f):

(b) either or both of Nb: 0.002% to 0.08% and Ti: 0.002% to 0.12%;

(c) either or both of Cu: 0.005% to 1% and Ni: 0.01% to 1%;

(d) one or more selected from the group consisting of Cr: 0.01% to 1.0%, Mo: 0.01% or more and less than 0.3%, V: 0.003% to 0.5%, Zr: 0.005% to 0.2%, and W: 0.005% to 0.2%;

(e) one or more selected from the group consisting of Ca: 0.0002% to 0.0030%, Ce: 0.0002% to 0.0030%, La: 0.0002% to 0.0030%, and Mg: 0.0002% to 0.0030%; and (f) either or both of Sb: 0.002% to 0.1% and Sn: 0.002% to 0.1%; and the balance consisting of Fe and incidental impurities, and that satisfies a relation expressed by:

$$5[\%\ S]+[\%\ N]<0.0115 \quad (1),$$

where [% S] and [% N] denote contents in mass % of S and N in steel, respectively.

8. A method for manufacturing the cold-rolled steel sheet of claim 5, comprising:

hot rolling a steel slab having the chemical composition as recited in claim 5 with a slab reheating temperature of higher than 1,200° C. to obtain a hot-rolled steel sheet;

then cold rolling the hot-rolled steel sheet with a rolling reduction of 20% to 75% to obtain a cold-rolled steel sheet having a sheet thickness of 0.5 mm to 2.6 mm;

then subjecting the cold-rolled steel sheet to continuous annealing, in which the cold-rolled steel sheet is:

subjected to soaking with an annealing temperature of higher than 850° C. and no higher than 910° C. for a duration of more than 300 seconds and no more than 900 seconds;

then cooled from 680° C. or higher to 260° C. or lower at a mean cooling rate of 70° C./s or higher;

then optionally reheated; and then retained in a temperature range of 150° C. to 260° C. for 20 seconds to 1,500 seconds, wherein the hot rolling comprises:

finish rolling the steel slab with a finisher delivery temperature of 840° C. to 950° C.;

then cooling the hot-rolled steel sheet to 700° C. or lower at a cooling rate of 40° C./s or higher;

then retaining the hot-rolled steel sheet at a temperature range of 600° C. to 700° C. for 4 seconds or more;

then cooling the hot-rolled steel sheet to a temperature range of 500° C. to 630° C.; and then coiling hot-rolled steel sheet.

* * * * *